US011980330B2

(12) United States Patent
Lee et al.

(10) Patent No.: US 11,980,330 B2
(45) Date of Patent: May 14, 2024

(54) ROBOT CLEANER AND ROBOT CLEANING SYSTEM INCLUDING THE SAME

(71) Applicant: LG ELECTRONICS INC., Seoul (KR)

(72) Inventors: Young Sub Lee, Seoul (KR); Hwan Yoo, Seoul (KR); Yonggil Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 422 days.

(21) Appl. No.: 17/363,278

(22) Filed: Jun. 30, 2021

(65) Prior Publication Data

US 2022/0000328 A1 Jan. 6, 2022

(30) Foreign Application Priority Data

Jul. 1, 2020 (KR) ..... 10-2020-0080835

(51) Int. Cl.
*A47L 11/40* (2006.01)
*A47L 11/282* (2006.01)

(52) U.S. Cl.
CPC ..... *A47L 11/4061* (2013.01); *A47L 11/282* (2013.01); *A47L 11/4011* (2013.01); *A47L 2201/00* (2013.01)

(58) Field of Classification Search
CPC ..... A47L 2201/04
See application file for complete search history.

(56) References Cited

U.S. PATENT DOCUMENTS

2021/0068605 A1* 3/2021 Kim ..... G06F 3/04842
2021/0330166 A1* 10/2021 Wu ..... A47L 11/4091

FOREIGN PATENT DOCUMENTS

KR 10-2009-0096009 9/2009

* cited by examiner

*Primary Examiner* — Spencer E. Bell
(74) *Attorney, Agent, or Firm* — KED & ASSOCIATES, LLP

(57) ABSTRACT

The present invention relates to a robot cleaner capable of receiving a user input setting a reference distance for detecting a surrounding environment of a space to be cleaned through an external control device, and controlling driving based on the user input, and a robot cleaner system including the same, and according to the present invention, the actuator of the robot cleaner is controlled based on the reference distance set by the user, so that the robot cleaner can be controlled not to fall into inability to drive according to a cleaning environment.

9 Claims, 18 Drawing Sheets

[FIG. 1]
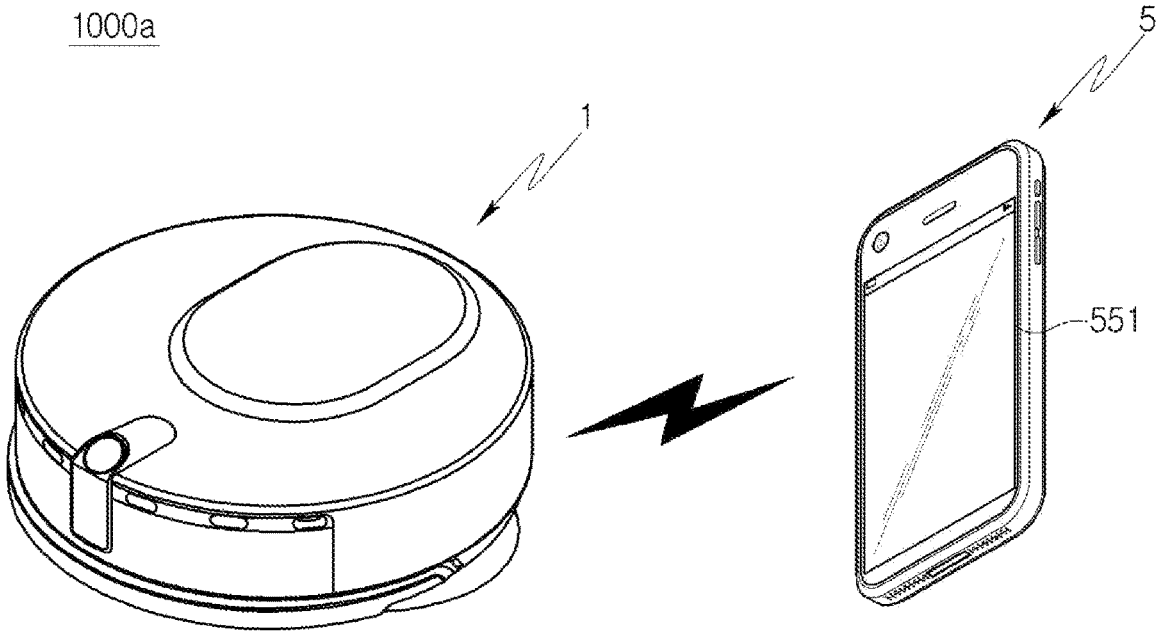

[FIG. 2a]
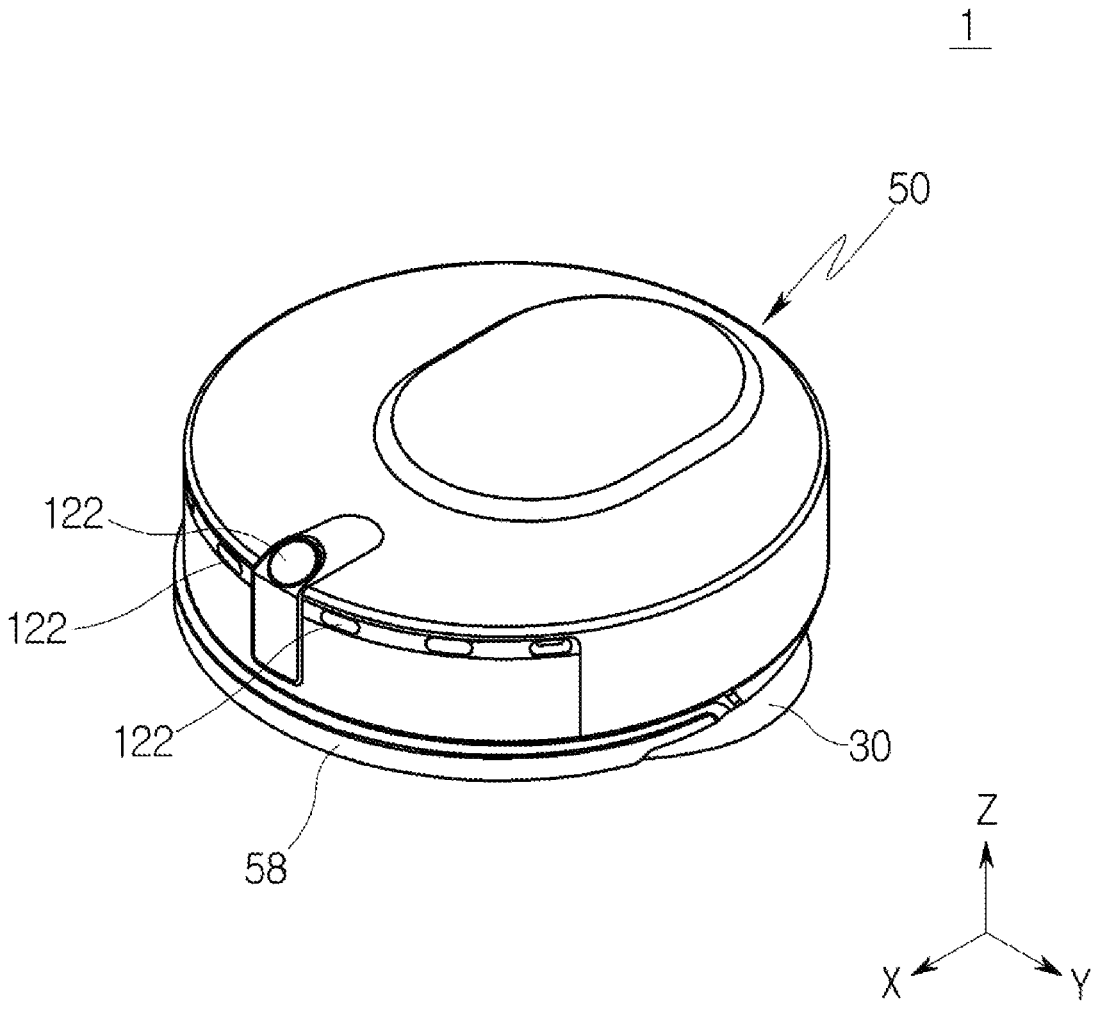

[FIG. 2b]
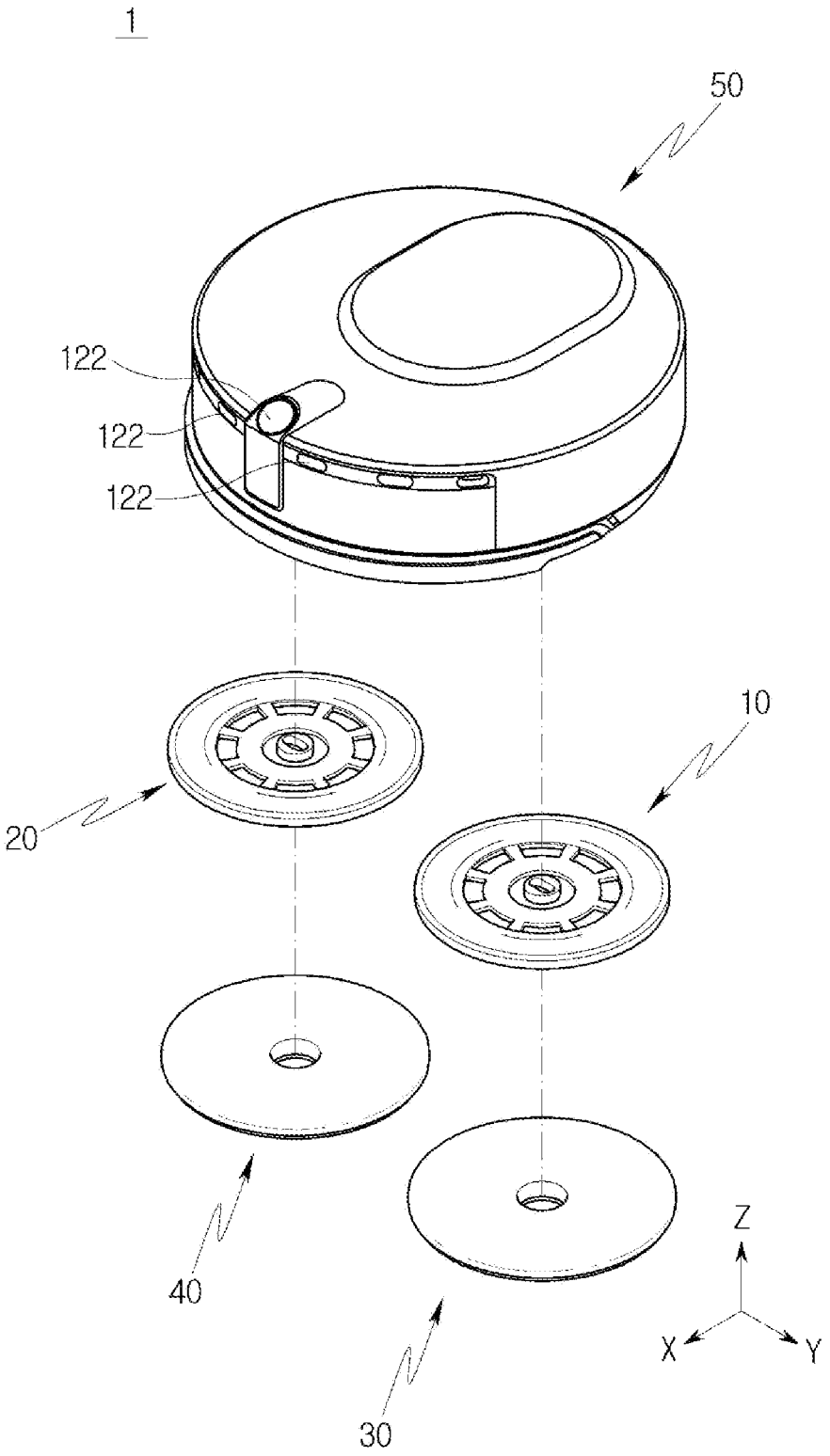

[FIG. 2c]
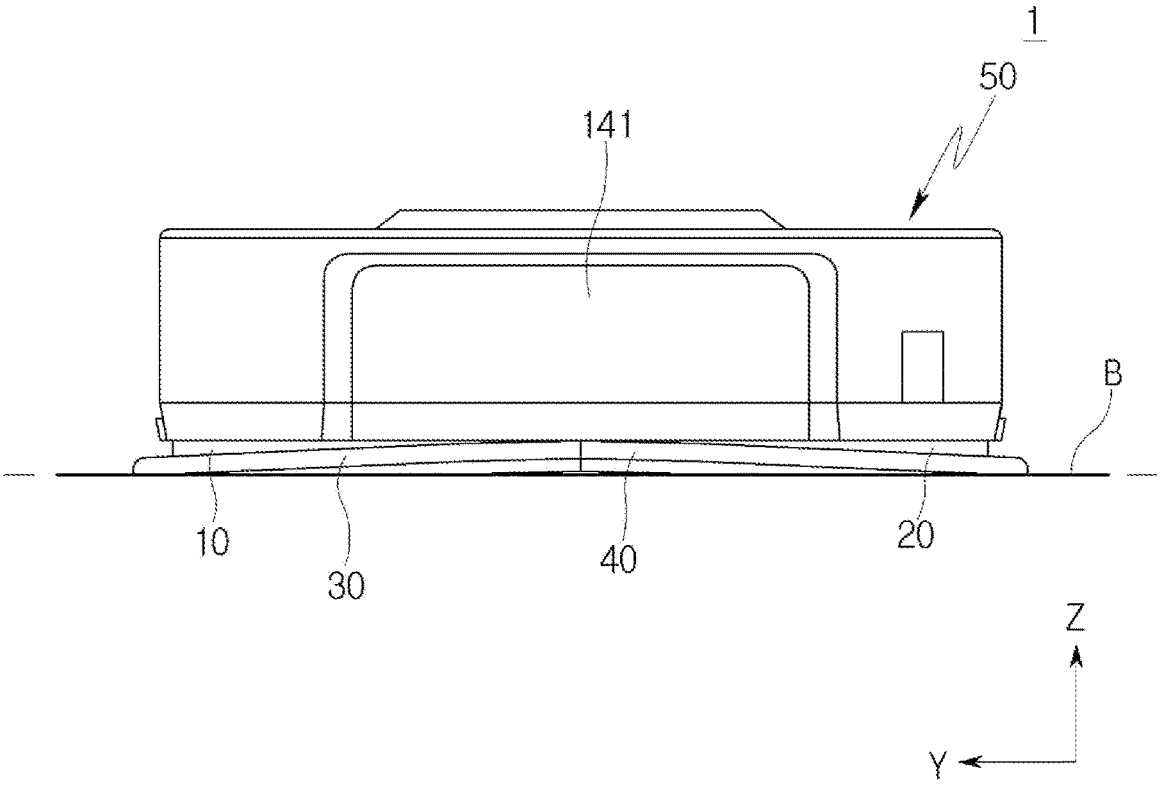

[FIG. 2d]
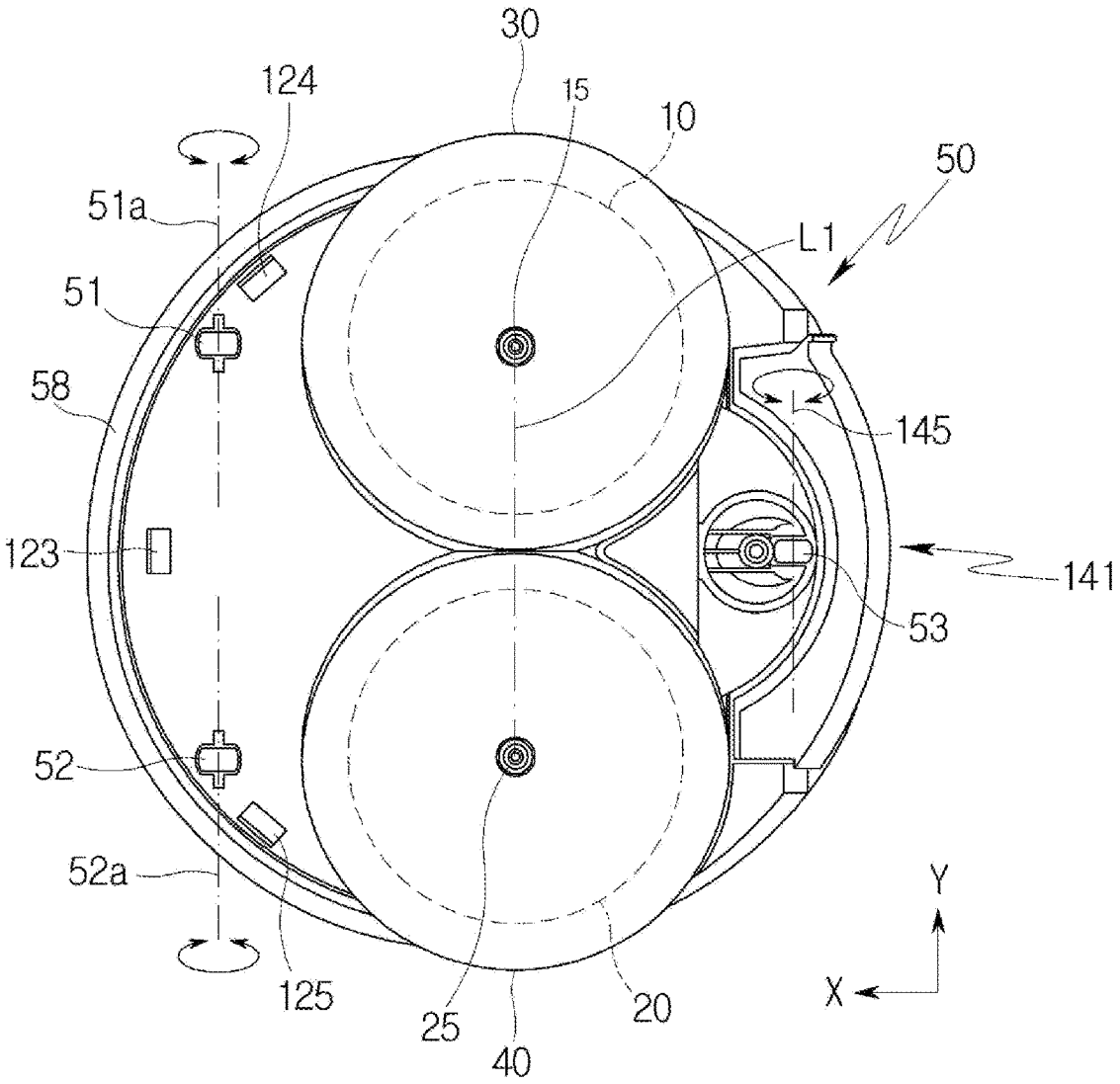

[FIG. 2e]
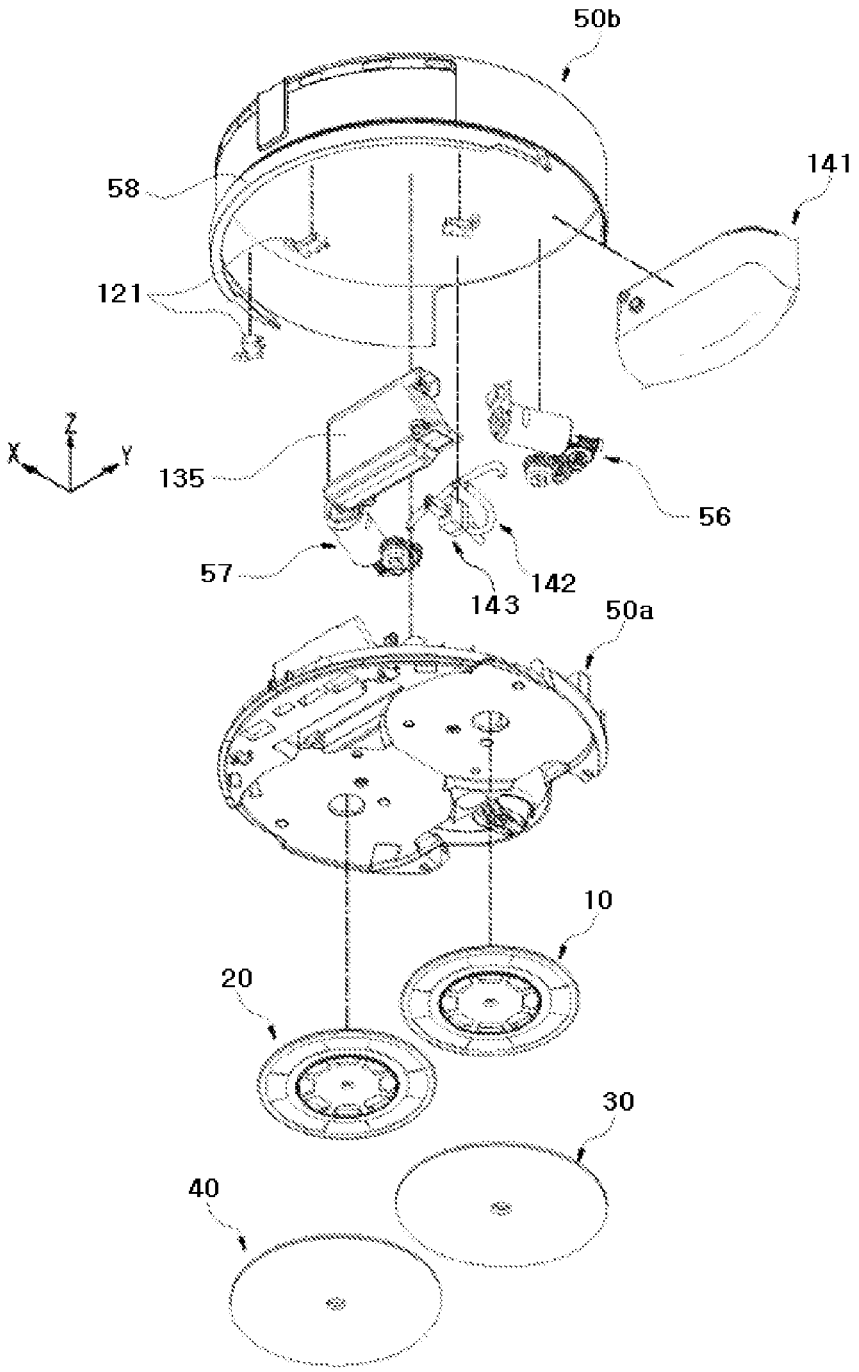

[FIG. 2f]
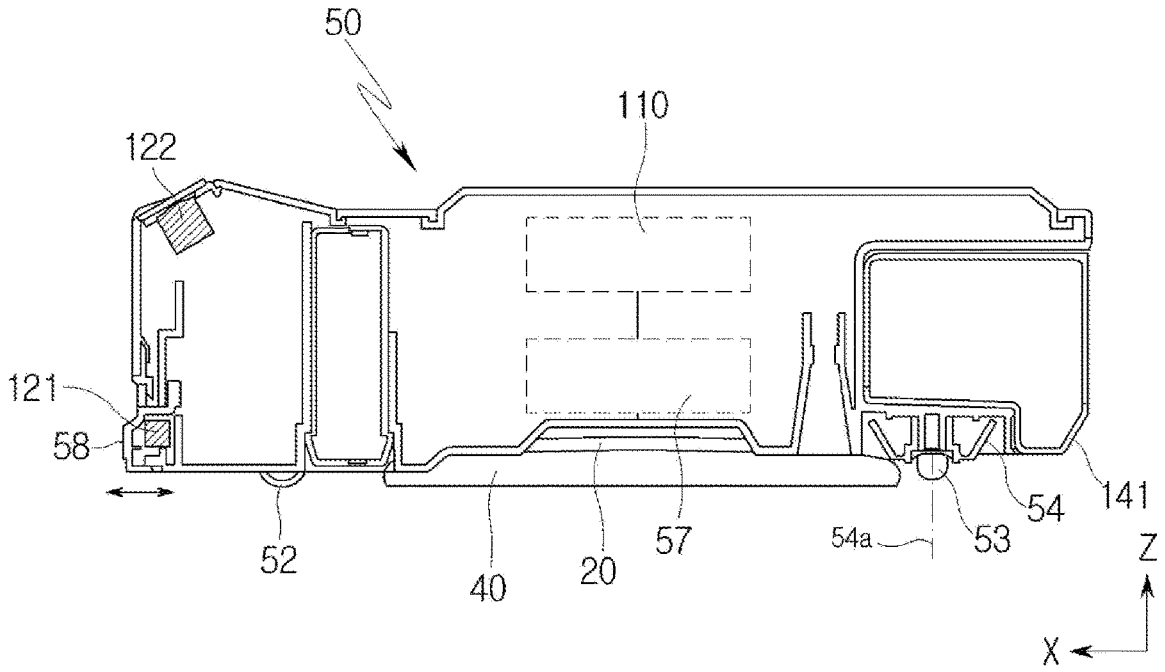

[FIG. 3]
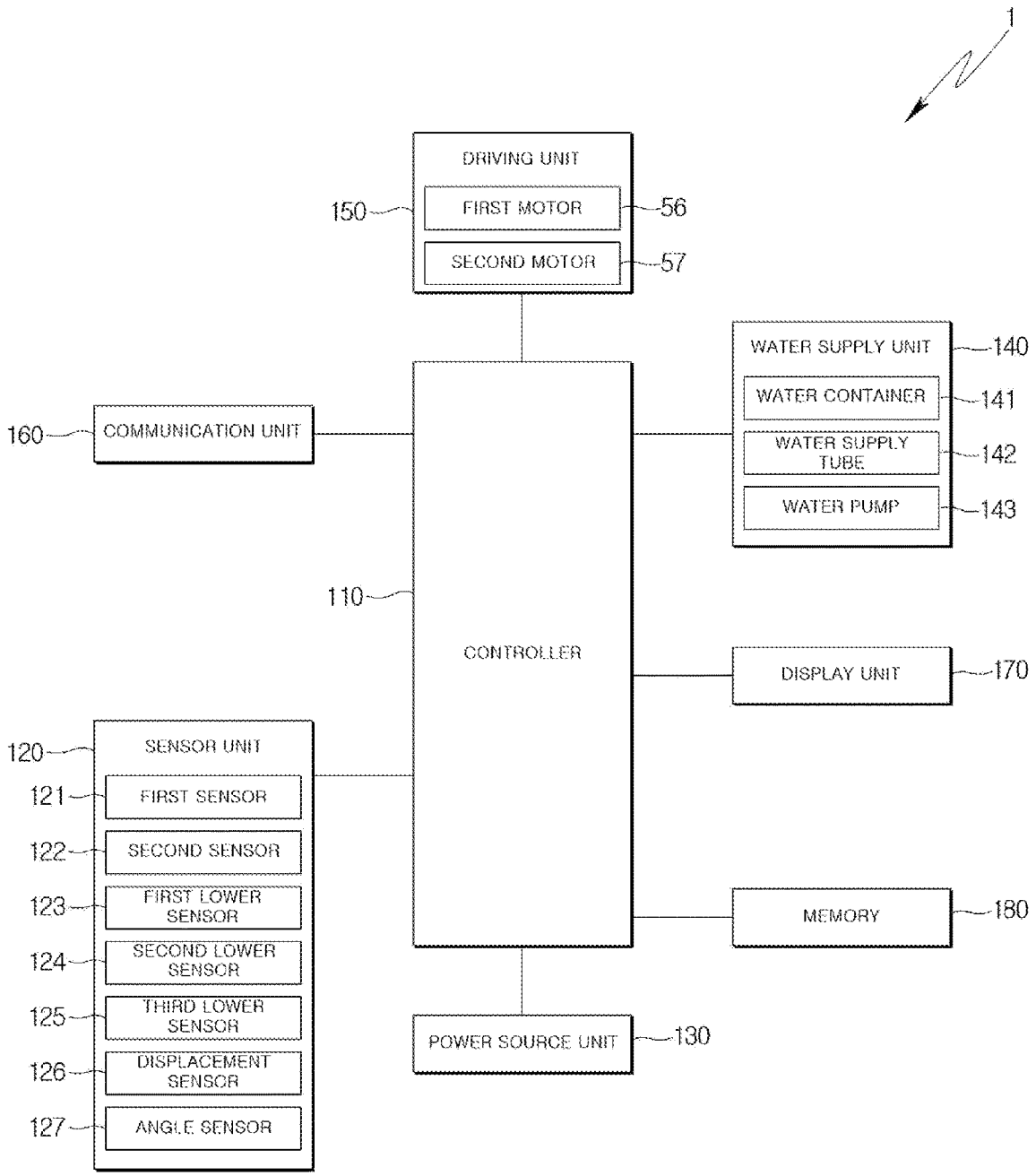

[FIG. 4]
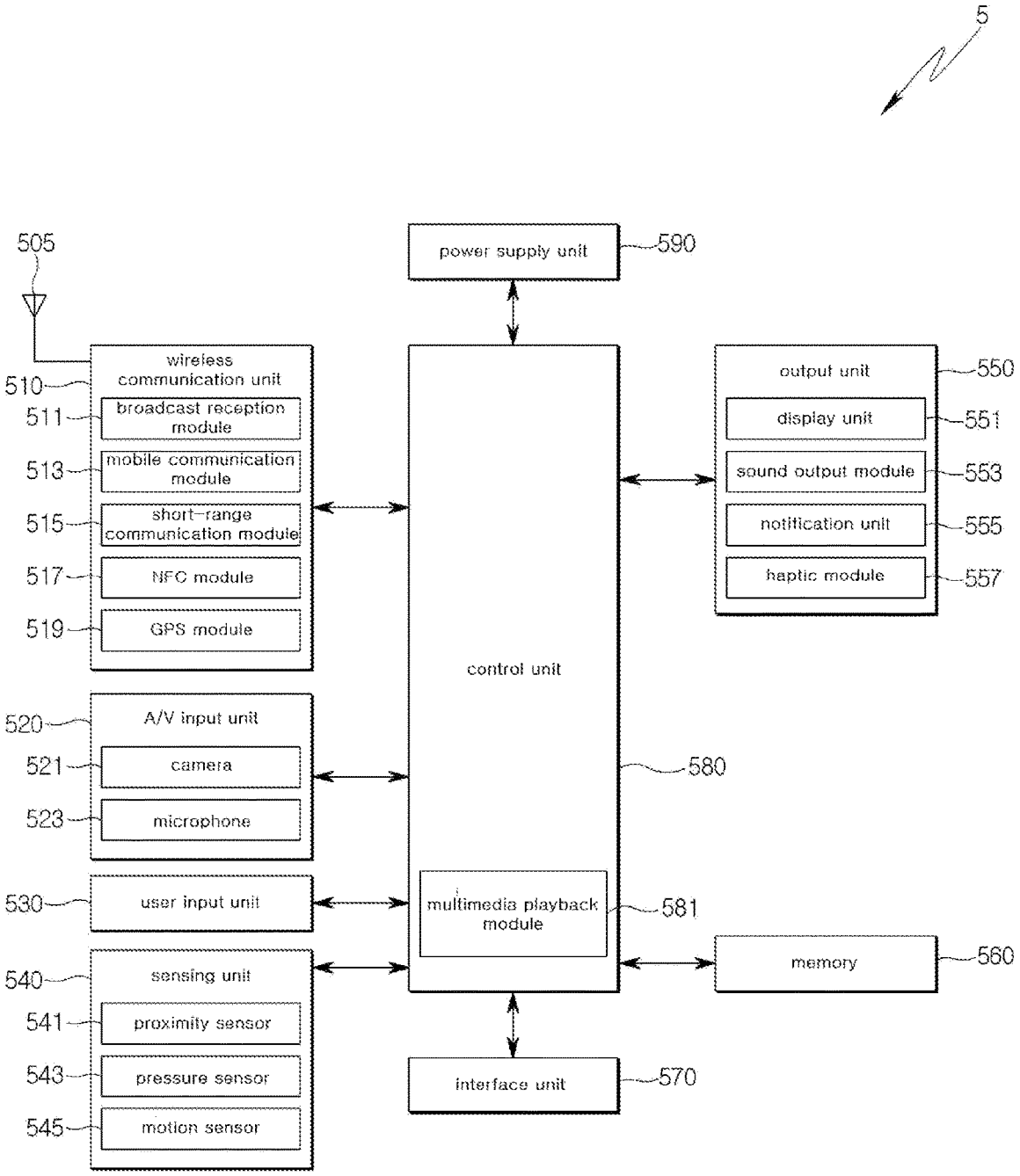

[FIG. 5a]
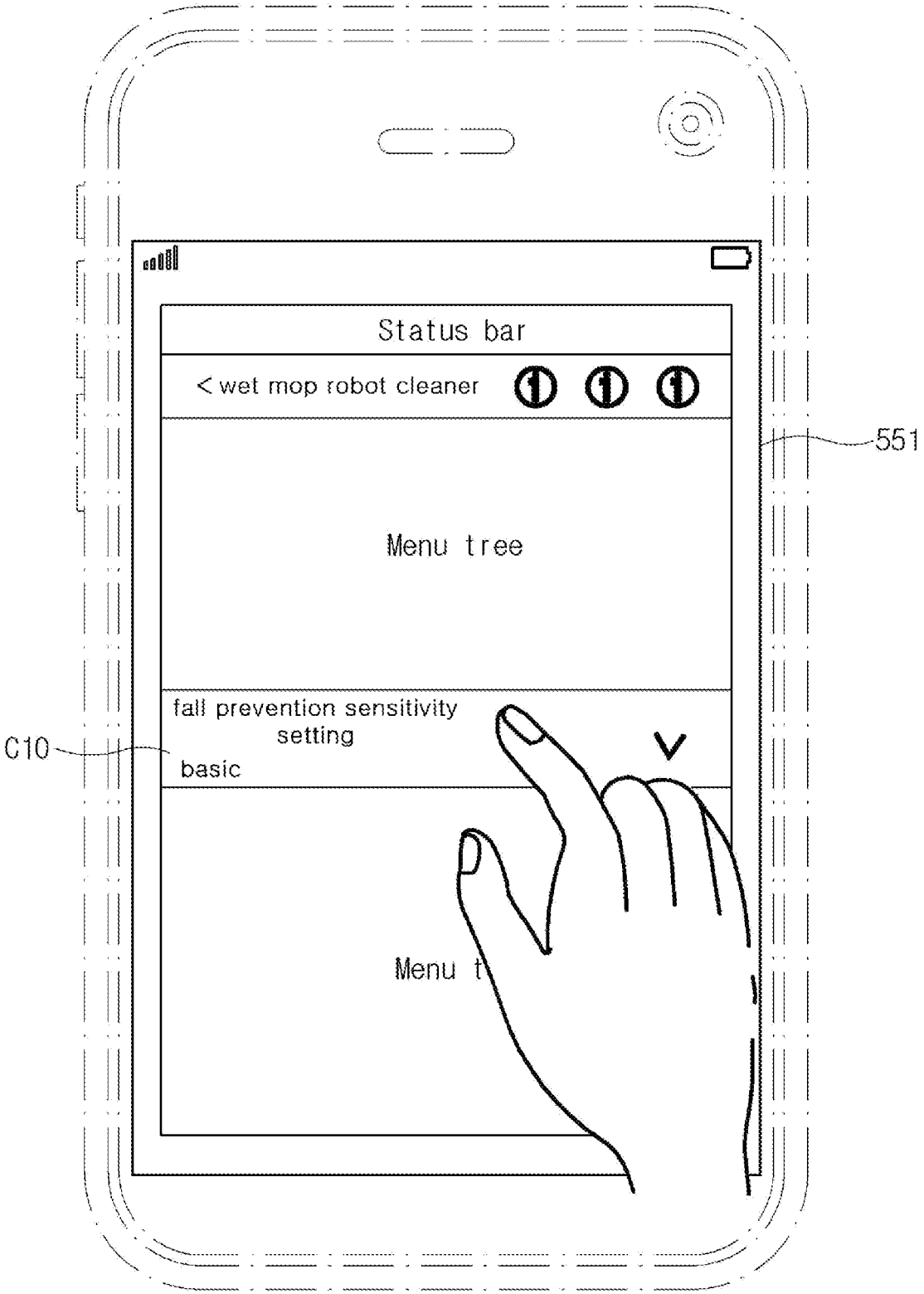

[FIG. 5b]
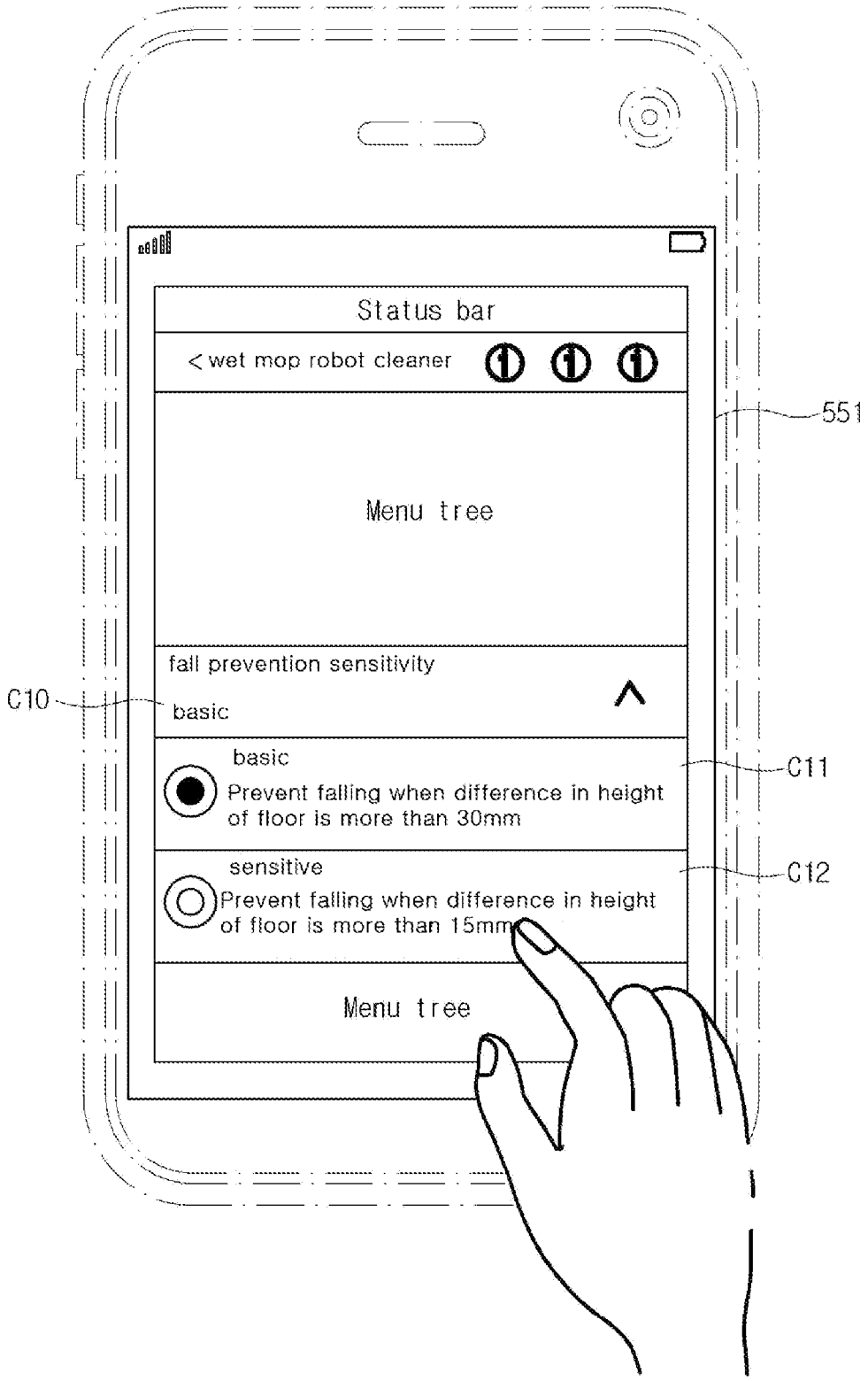

[FIG. 6]
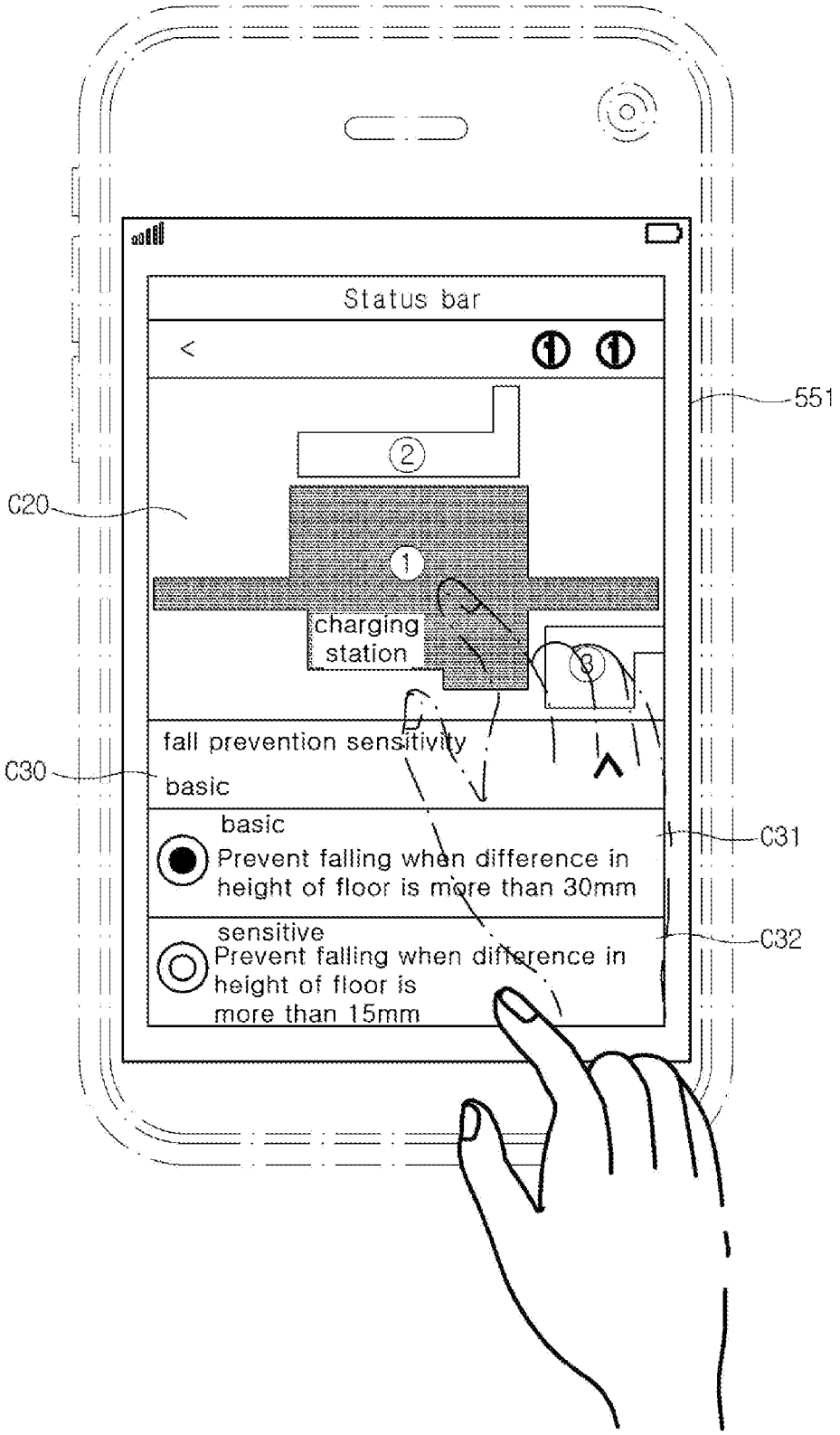

[FIG. 7]
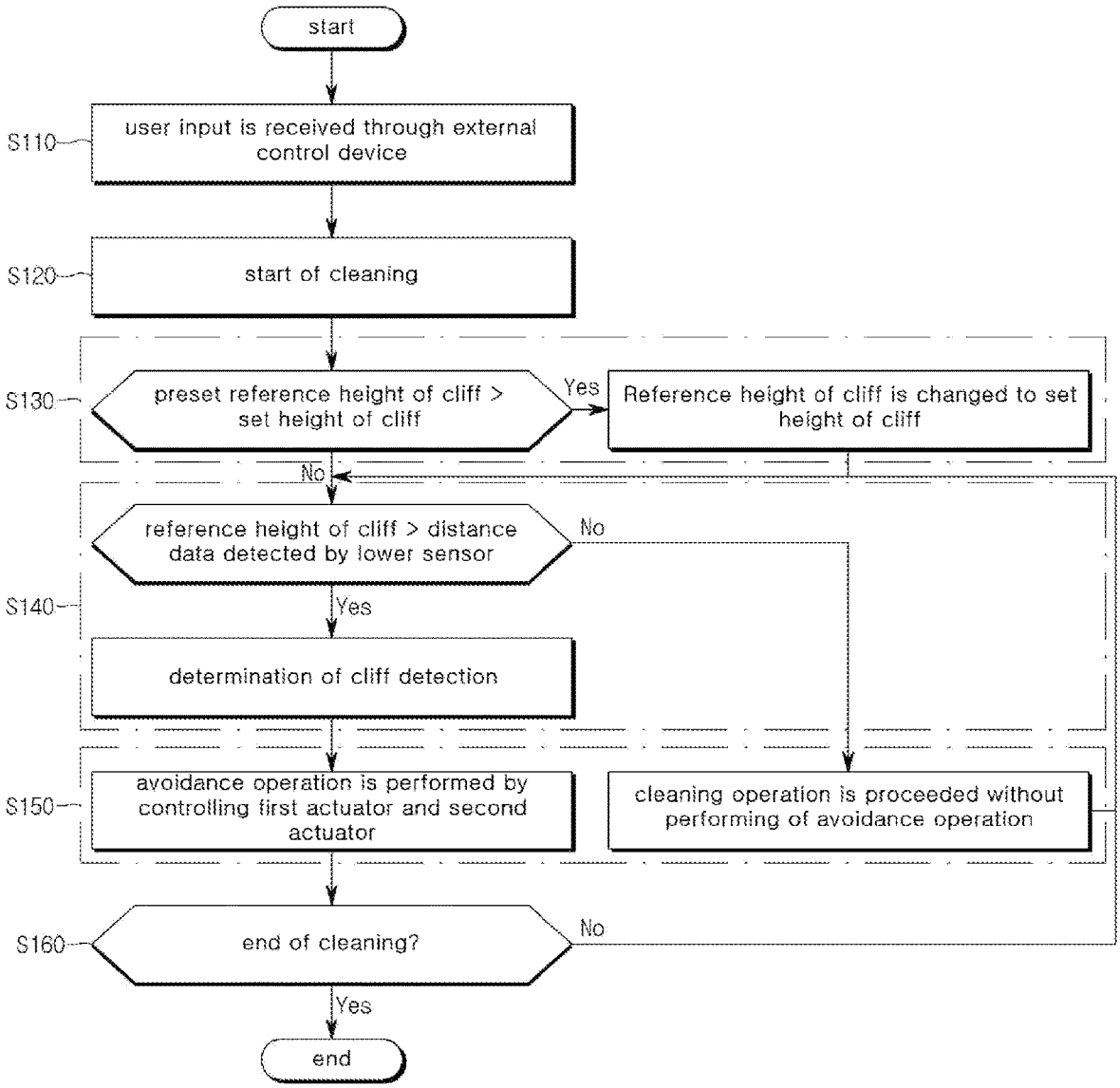

[FIG. 8]
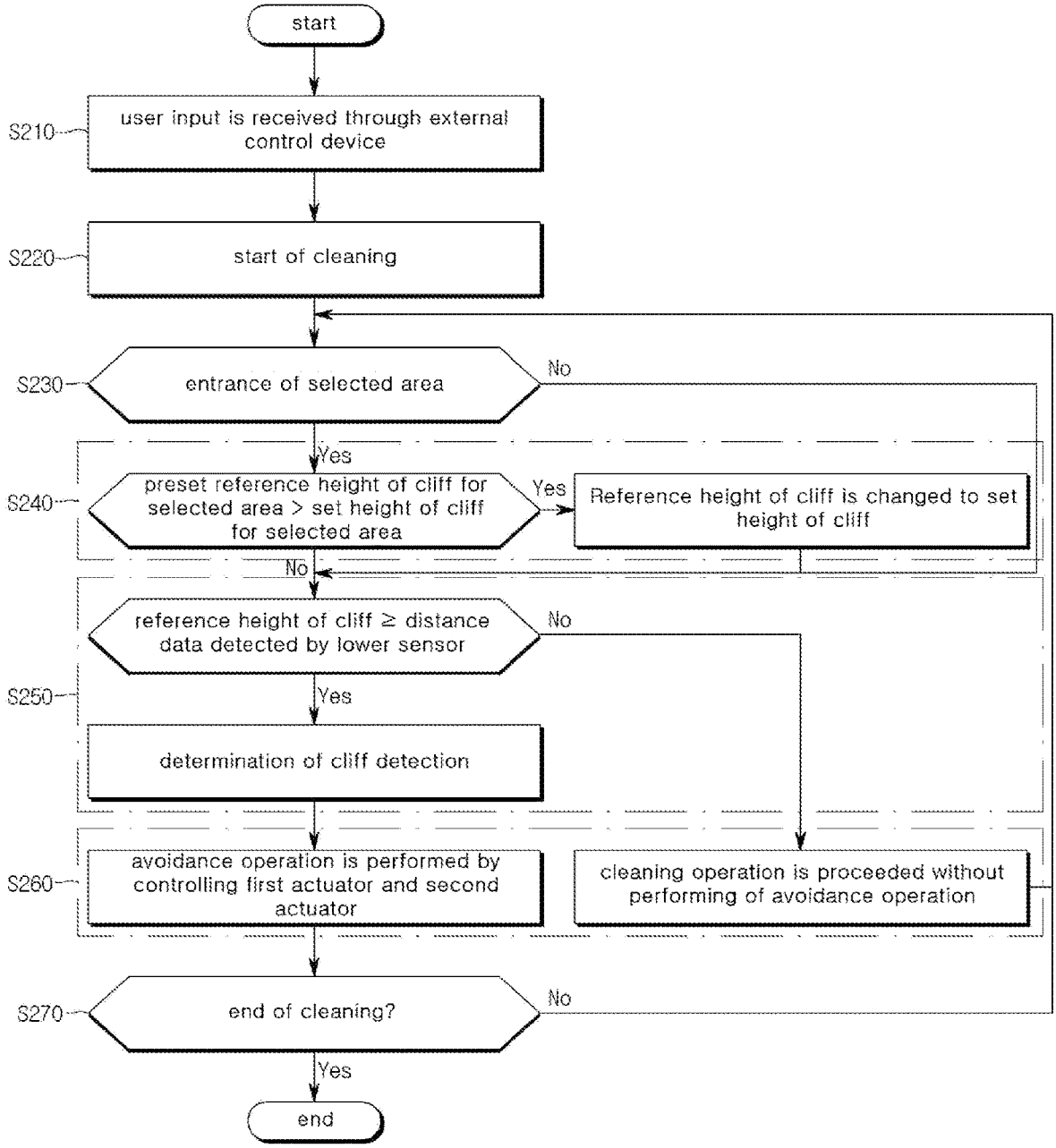

[FIG. 9]
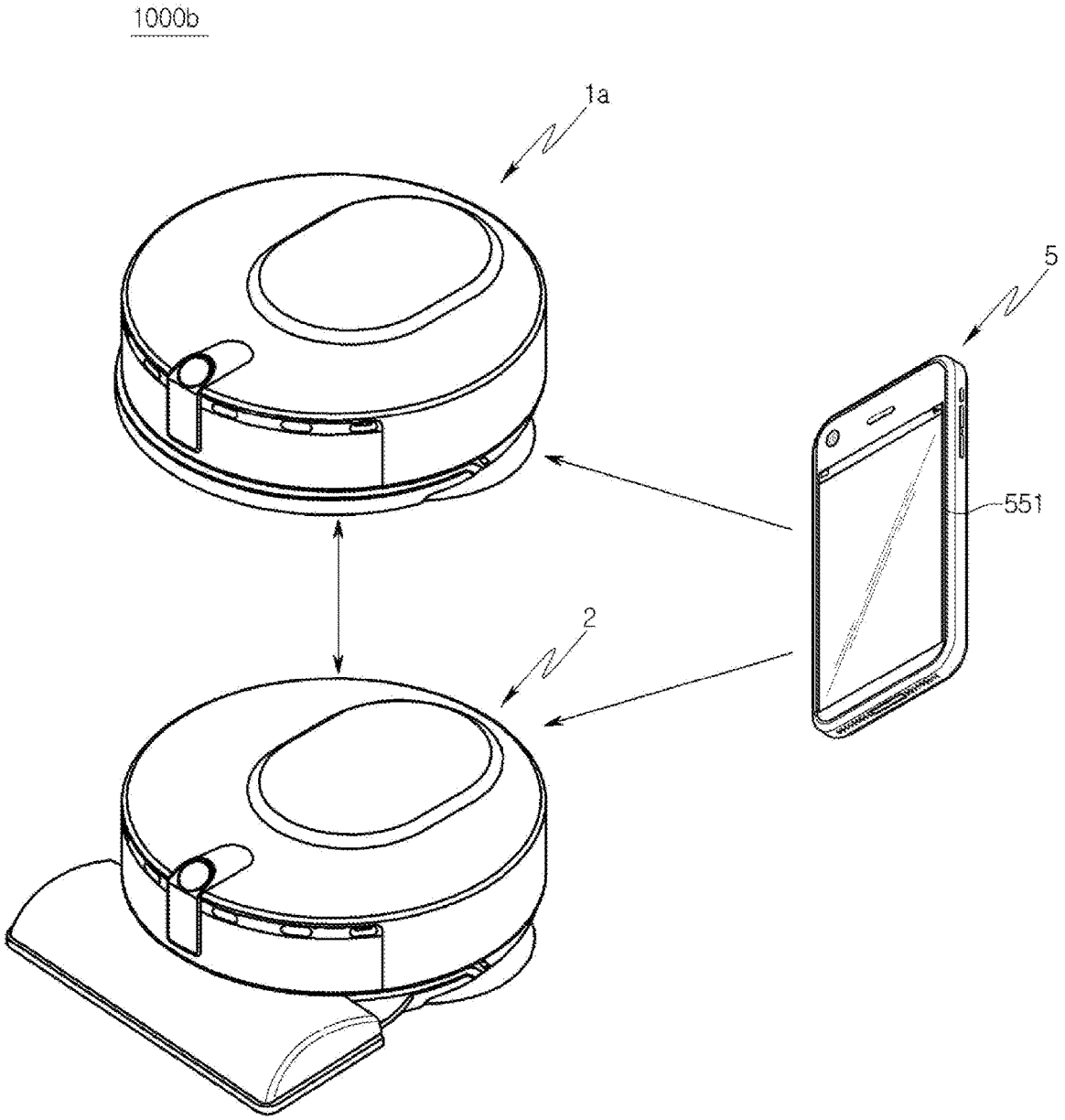

[FIG. 10]
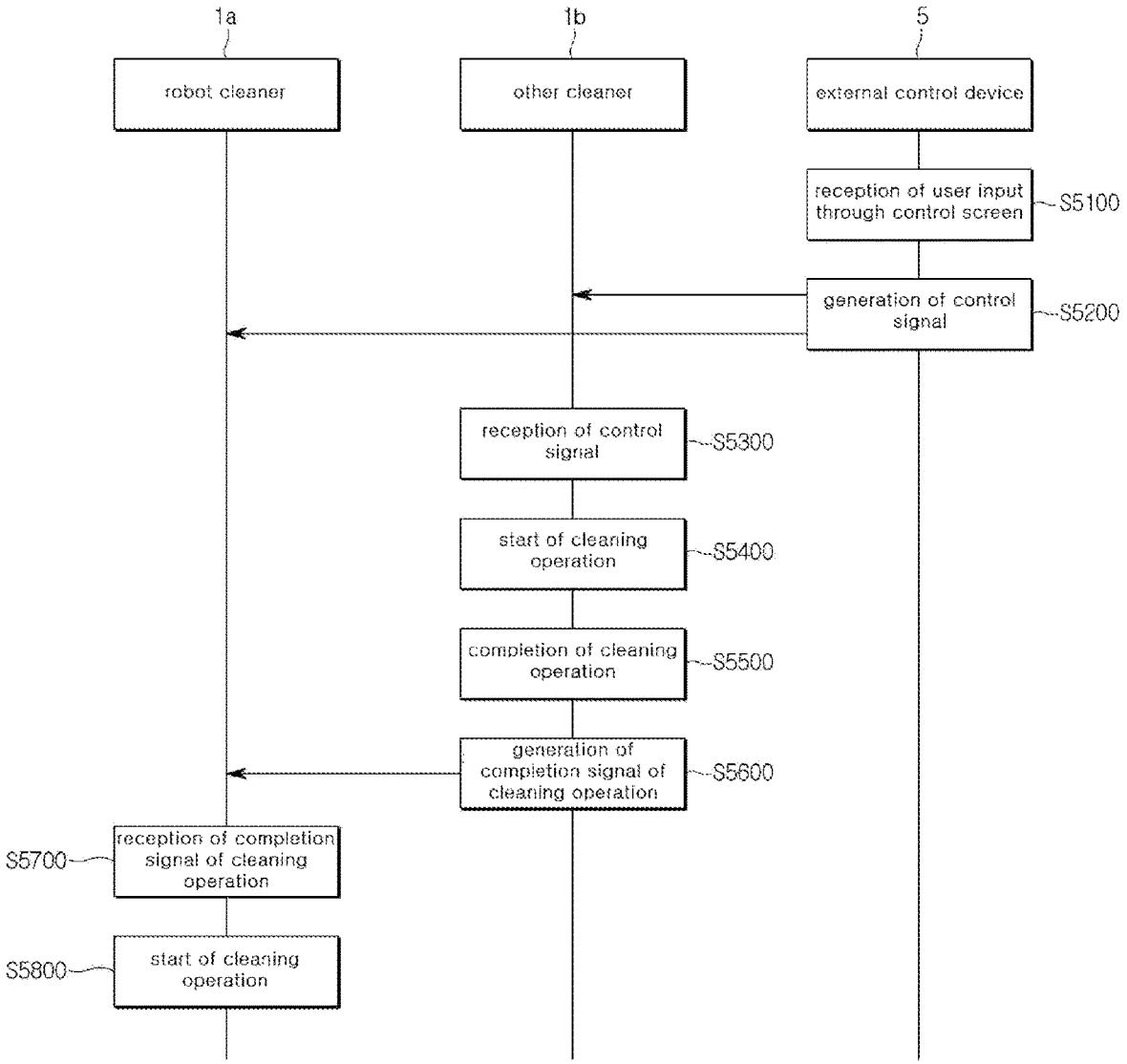

[FIG. 11a]
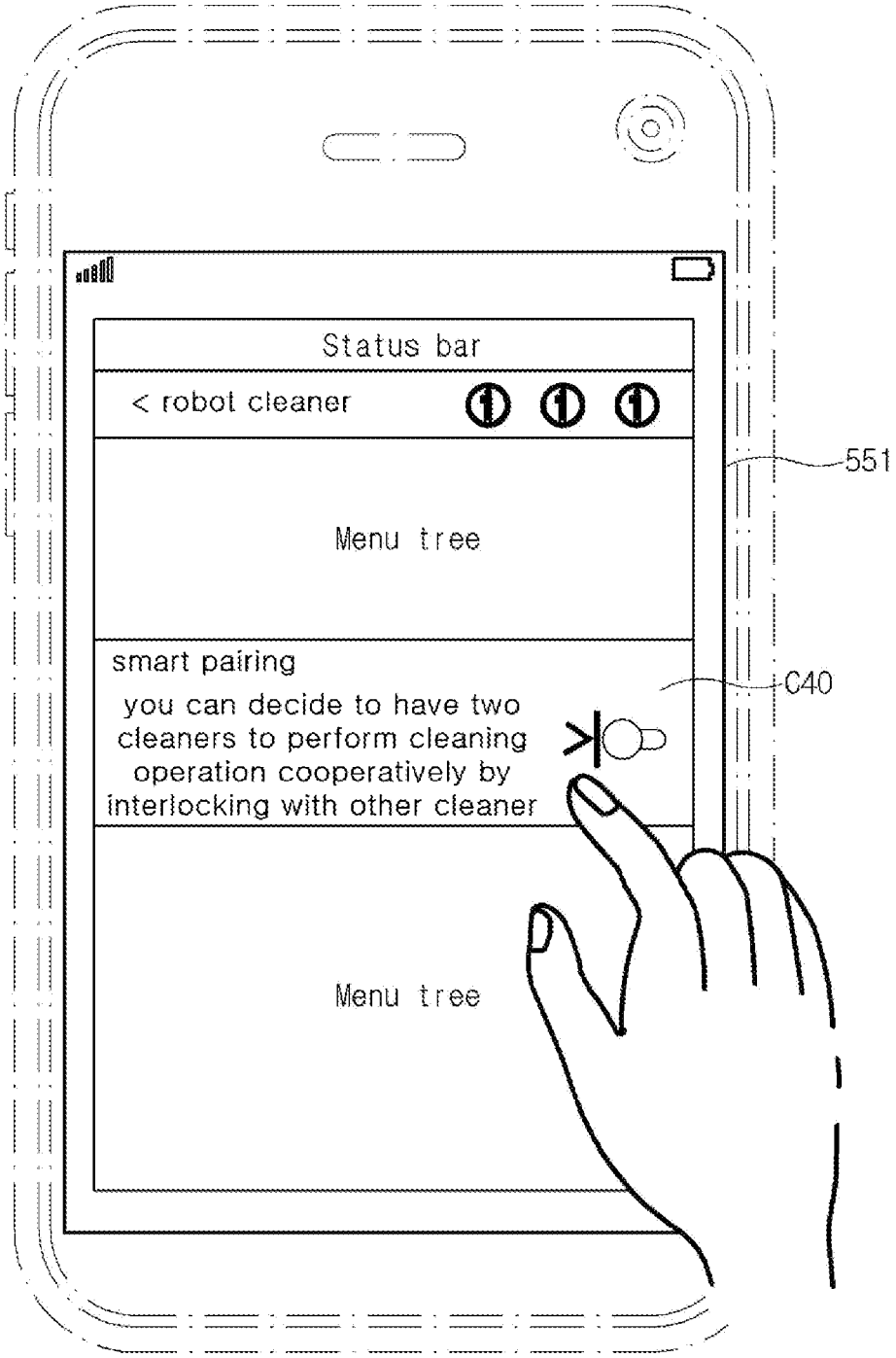

[FIG. 11b]
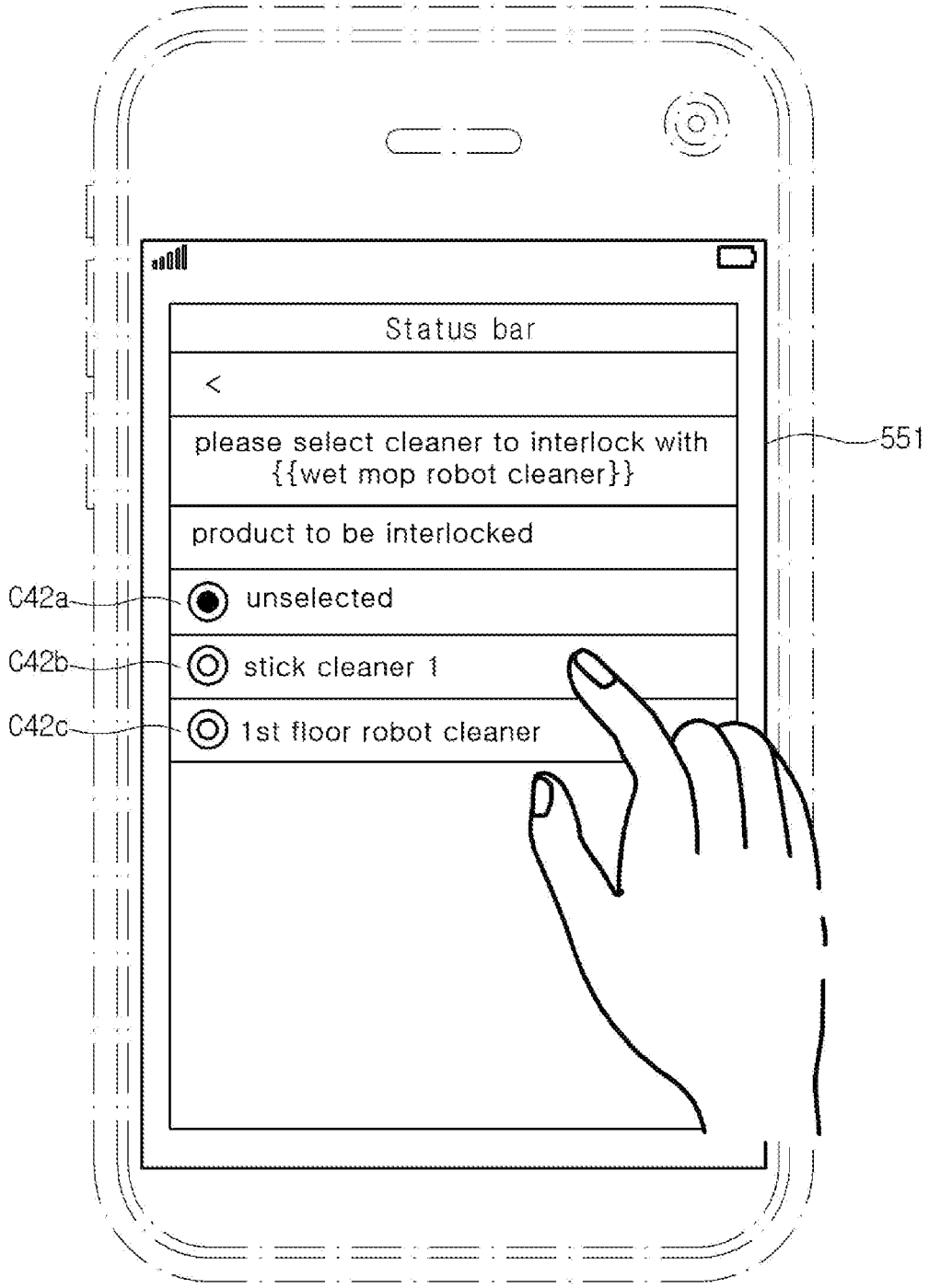

ROBOT CLEANER AND ROBOT CLEANING SYSTEM INCLUDING THE SAME

CROSS-REFERENCE TO RELATED APPLICATION(S)

This application claims priority under 35 U.S.C. § 119 to Korean Application No. 10-2020-0080835 filed on Jul. 1, 2020, whose entire disclosure(s) is/are hereby incorporated by reference.

TECHNICAL FIELD

The present invention relates to a robot cleaner which receives user input setting a reference distance for detecting a surrounding environment of a space to be cleaned through an external control device, and controls driving based on the received user input, and a robot cleaning system including the same.

BACKGROUND ART

A robot cleaner is a household robot that autonomously drives on a surface to be cleaned with a certain area and removes dust or foreign substances around it, and according to its function, it is generally classified into a suction-type robot cleaner that sucks dust by vacuum, and a wet robot cleaner with a web mop function that wipes the surface to be cleaned using a mop.

On the other hand, the wet robot cleaner (hereinafter referred to as "robot cleaner") having the wet mop function has a water tank, and it is configured to supply the water contained in the water tank to the mop, and to wipe a floor surface with the moisture mop, thereby effectively removing foreign substance strongly attached to the floor surface.

Such a robot cleaner may include various sensors to sense the surrounding environment of an area to be cleaned while driving.

For example, the robot cleaner is provided with a sensor for detecting a cliff in which the level of a floor surface is suddenly lowered in a space to be cleaned, and when the height between the floor surface and the bottom surface of the robot cleaner is higher than a certain height, it is detected as a cliff Therefore, it is possible to prevent the robot cleaner from falling off the cliff by driving while avoiding the area.

Alternatively, for example, the robot cleaner may be provided with a sensor for detecting in advance and avoiding a wall surface in the space to be cleaned, and may be provided with a sensor for detecting a situation in which the robot cleaner collides with an object.

On the other hand, in the case of a suction-type robot cleaner, since it drives using wheels, it is possible to reclimb by the driving force using the wheels even if the robot cleaner falls from a low step that is not recognized as a cliff. However, since the robot cleaner that performs a wet mop cleaning drives using the mop coupled to the lower side of the robot cleaner, there is a problem that it cannot climb again by itself once it falls even with a low step and falls into a driving inability state.

Therefore, it is necessary to set a reference height value of cliff differently according to a usage environment so that the robot cleaner that performs the wet mop cleaning does not fall into a driving inability state while performing the cleaning operation.

Korean Patent Laid-Open Patent No. 10-2009-0096009 discloses a front sensor, a rear sensor, and an intermediate sensor for detecting the distance between the bottom surface of a cleaner body and a floor surface, and a configuration to compare the distances detected by the front sensor, the rear sensor and the intermediate sensor and determine whether the floor surface is a cliff or a threshold.

However, in the case of Korean Patent Laid-Open Patent Publication No. 10-2009-0096009, there is a problem that the reference height value of cliff cannot be set differently according to the usage environment because the detecting reference height value for cliff is fixed.

DOCUMENT OF RELATED ART

Patent Document (Patent Literature 1) Korean Patent Laid-Open Patent Publication No. 10-2009-0096009

DISCLOSURE

Technical Problem

An object of the present invention is to provide a robot cleaner capable of controlling a cliff height of the robot cleaner according to a cleaning environment.

In addition, an object of the present invention is to provide a robot cleaning system in which a user can remotely set a cliff height of a robot cleaner.

Technical Solution

In order to achieve the above objection, an embodiment of the present invention provides a robot cleaner which cleans a space to be cleaned while automatically driving, including a body; a first rotation plate that is coupled to the body to rotate and to whose lower side a first mop facing a bottom surface of the space to be cleaned is coupled; a second rotation plate that is coupled to the body to rotate and to whose lower side a second mop facing the bottom surface of the space to be cleaned is coupled; a sensor unit that is coupled to the body and includes at least one sensor to detect distance data of the space to be cleaned; a first actuator that is coupled to the body to provide power to rotate the first rotation plate; and a second actuator that is coupled to the body to provide power to rotate the second rotation plate, wherein the first actuator and the second actuator are controlled based on a reference distance that is set by a user input through an external control device and detects a surrounding environment of the space to be cleaned, and the distance data detected by the sensor unit.

Here, the sensor unit includes a lower sensor to detect a height from the bottom surface in the space to be cleaned to a lower side of the robot cleaner, and the reference distance set by the user input is a height of cliff.

Meanwhile, the present invention may further include a control unit that controls operations of the first actuator and the second actuator by communicating with the external control device, the control unit receives the user input setting the height of cliff through the external control device, the control unit changes a reference height of cliff to the set height of cliff if the reference height of cliff preset in the robot cleaner is less than the height of cliff set by the user input, during performing cleaning operation, the control unit determines that the cliff is detected if the distance data detected by the lower sensor is greater than the reference height of the cliff, the control unit may control the first actuator and the second actuator to perform an avoidance operation to avoid the cliff.

In addition, the present invention may further include a control unit that controls operations of the first actuator and the second actuator by communicating with the external control device, the control unit receives the user input selecting one or more areas among the space to be cleaned having a plurality of divided areas, and the user input setting a height of cliff corresponding to each of the selected areas through the external control device, when the robot cleaner enters the selected area, the control unit compares a preset reference height of cliff for the selected area with the height of cliff set by the user input corresponding to the selected area, and changes the reference height of cliff to the set height of cliff if the reference height of cliff is less than the set height of cliff, during performing the cleaning operation, the control unit determines that the cliff is detected if the distance data detected by the sensor unit is greater than the reference height of the cliff, the control unit may control the first actuator and the second actuator to perform an avoidance operation to avoid the cliff.

Meanwhile, the control unit may control the first actuator and the second actuator so that only one of the first rotation plate and the second rotation plate rotates.

In addition, the control unit may control the first actuator and the second actuator so that the first rotation plate and the second rotation plate respectively rotate in an opposite direction to a rotation direction up to that time.

A robot cleaning system according to an embodiment of the present invention may include a robot cleaner that cleans a space to be cleaned while autonomously driving; and an external control device that displays a control screen for controlling the robot cleaner and receives a reference distance for detecting a surrounding environment of the space to be cleaned from a user through the control screen.

Here, the robot cleaner includes a lower sensor that detects a height from a bottom surface of the space to be cleaned to a lower side of the robot cleaner, the reference distance set by the user input is a height of cliff, the external control device displays on the control screen a plurality of heights items of cliff selectable by the user input.

In addition, when the user selects one height of cliff item among the plurality of height items of cliff, the external control device may transmit information on the height of cliff corresponding to the selected height item of cliff to the robot cleaner.

Meanwhile, a robot cleaning system according to another embodiment of the present invention further includes other cleaner to perform a cleaning operation in cooperation with the robot cleaner, when the external control device receives the user input selecting the other cleaner on the control screen, the robot cleaner starts a cleaning operation by receiving a cleaning completion signal transmitted after the other cleaner completes cleaning.

Advantageous Effect

The robot cleaner according to the present invention may control an actuator of the robot cleaner based on a height of cliff set by a user so that the robot cleaner does not fall into inability to drive according to a cleaning environment.

In addition, the robot cleaning system according to the present invention is provided with an external control device that receives a user input and displays a control screen for setting a height of cliff on a robot cleaner, so that the user can remotely conveniently set the driving control of the robot cleaner.

DESCRIPTION OF DRAWINGS

FIG. 1 is a conceptual view of a robot cleaning system according to an embodiment of the present invention.

FIG. 2*a* is a perspective view illustrating a robot cleaner according to an embodiment of the present invention.

FIG. 2*b* is a view illustrating a partially separated configuration of a robot cleaner according to an embodiment of the present invention.

FIG. 2*c* is a rear view of a robot cleaner according to an embodiment of the present invention.

FIG. 2*d* is a bottom view of a robot cleaner according to an embodiment of the present invention.

FIG. 2*e* is an exploded perspective view of a robot cleaner according to an embodiment of the present invention.

FIG. 2*f* is an internal cross-sectional view of a robot cleaner according to an embodiment of the present invention.

FIG. 3 is a block diagram of a robot cleaner according to an embodiment of the present invention.

FIG. 4 is an internal block diagram of the external control device of FIG. 1.

FIGS. 5*a* and 5*b* are views illustrating an example of a control screen of an external control device for setting a height of cliff.

FIG. 6 is a view illustrating an example of a control screen of an external control device for setting a height of cliff by selecting an area.

FIG. 7 is a flowchart illustrating an example of setting a height of cliff in a robot cleaning system according to an embodiment of the present invention.

FIG. 8 is a flowchart illustrating an example of setting a height of cliff by selecting an area in the robot cleaning system according to an embodiment of the present invention.

FIG. 9 is a conceptual view of a robot cleaning system according to another embodiment of the present invention.

FIG. 10 is a flowchart illustrating a method of performing a cooperative cleaning operation in conjunction with other cleaner in a method for controlling a robot cleaning system according to another embodiment of the present invention.

FIGS. 11*a* and 11*b* are views illustrating a control screen of an external control device for setting the cooperative cleaning operation in a robot cleaning system according to another embodiment of the present invention.

MODE FOR INVENTION

Hereinafter, preferred embodiments of the present invention will be described in detail with reference to the accompanying drawings.

Since the present invention can have various changes and can have various embodiments, specific embodiments are illustrated in the drawings and will be described in detail in the detailed description. This is not intended to limit the present invention to a specific embodiment, it should be construed to include all modifications, equivalents and substitutes included in the spirit and scope of the present invention.

In describing the present invention, terms such as first and second may be used to describe various components, but the components may not be limited by the terms. The above terms are only for the purpose of distinguishing one component from another. For example, without departing from the scope of the present invention, a first component may be referred to as a second component, and similarly, a second component may also be referred to as a first component.

The term "and/or" may include a combination of a plurality of related listed items or any of a plurality of related listed items.

When a component is referred to as being "connected" or "contacted" to another component, it may be directly connected or contacted to the other component, but it may be understood that other components may exist in between. On the other hand, when it is mentioned that a certain element is "directly connected" or "directly contacted" to another element, it may be understood that the other element does not exist in the middle.

The terms used in the present application are only used to describe specific embodiments, and are not intended to limit the present invention. The singular expression may include the plural expression unless the context clearly dictates otherwise.

In the present application, terms such as "comprise" or "have" are intended to designate that a feature, number, step, operation, component, part, or combination thereof described in the specification exists, and it may be understood that the presence or addition of one or more other features, numbers, steps, operations, components, parts, or combinations thereof is not precluded in advance.

Unless defined otherwise, all terms used herein, including technical or scientific terms, may have the same meaning as commonly understood by one of ordinary skill in the art to which this invention belongs. Terms such as those defined in a commonly used dictionary may be interpreted as having a meaning consistent with the meaning in the context of the related art, and unless explicitly defined in the present application, it may not be interpreted in an ideal or excessively formal meaning.

In addition, the following embodiments are provided to more completely explain to those with average knowledge in the art, and the shapes and sizes of elements in the drawings may be exaggerated for clearer explanation.

FIG. 1 is a conceptual view of a robot cleaning system according to an embodiment of the present invention.

Referring to FIG. 1, a robot cleaning system 1000*a* according to an embodiment of the present invention includes a robot cleaner 1 and an external control device 5 for remotely controlling the robot cleaner.

Here, the robot cleaner 1 autonomously drives and cleans the floor surface of a space to be cleaned in which the robot cleaner 1 itself is installed. The robot cleaner 1 is installed in an inner space of a house and is configured to perform a cleaning operation of autonomously cleaning a floor surface according to a preset pattern or a command designated/inputted by a user while driving using one or more mops, and to perform short-range wireless communication.

The robot cleaner 1 may be remotely controlled by the external control device 5.

In this case, the external control device 5 is a portable wireless communication electronic device. For example, the external control device 5 may be a mobile phone, a PDA, a laptop, a digital camera, a game machine, an e-book, and the like. In addition, the external control device 5 may support short-range communication corresponding to the short-range communication of the robot cleaner 1.

Hereinafter, the robot cleaner 1 will be described in detail with reference to the structural views shown in FIGS. 2*a* to 2*f* and the block diagram shown in FIG. 3.

FIGS. 2*a* to 2*f* are structural views for explaining the structure of the robot cleaner 1.

More specifically, FIG. 2*a* is a perspective view showing a robot cleaner, FIG. 2*b* is a view illustrating a partially separated configuration of the robot cleaner, FIG. 2*c* is a rear view of the robot cleaner, FIG. 2*d* is a bottom view of the robot cleaner, FIG. 2*e* is an exploded perspective view of the robot cleaner, and FIG. 2*f* is an internal cross-sectional view of the robot cleaner.

The robot cleaner 1 according to the embodiment of the present invention is placed on a floor and moved along a floor surface B of a space to be cleaned to clean the floor. Accordingly, in the following description, the vertical direction is determined based on the state in which the robot cleaner 1 is placed on the floor.

And, based on a first rotation plate 10 and a second rotation plate 20, a side to which a first and second supporting wheels 51 and 52, which will be described later, are coupled is determined as a front side (front).

The 'lowest part' of each configuration described in an embodiment of the present invention may be the lowest-positioned part in each configuration when the robot cleaner 1 according to an embodiment of the present invention is placed on the floor for using, or may be a part closest to the floor.

The robot cleaner 1 according to an embodiment of the present invention is configured to include a body 50, a first rotation plate 10, a second rotation plate 20, a first mop 30 and a second mop 40.

The body 50 may form the overall outer shape of the robot cleaner 1 or may be formed in the form of a frame. Each component constituting the robot cleaner 1 may be coupled to the body 50, and some components constituting the robot cleaner 1 may be accommodated in the body 50. The body 50 can be divided into a lower body 50*a* and an upper body 50*b*, and the components of the robot cleaner 1 can be provided in a space in which the lower body 50*a* and the upper body 50*b* are coupled to each other. (See FIG. 2*e*).

In an embodiment of the present invention, the body 50 may be formed in a shape in which the width (or diameter) in the horizontal direction (direction parallel to X and Y) is larger than the height in the vertical direction (direction parallel to Z). This body 50 may help the robot cleaner 1 to achieve a stable structure, and provide a structure advantageous for avoiding obstacles in the movement (driving) of the robot cleaner 1.

When viewed from above or below, the body 50 may have various shapes, such as a circle, an oval, a square and the like.

The first rotation plate 10 is made to have a predetermined area, and is formed in the form of a flat plate, a flat frame and the like. The first rotation plate 10 is generally laid horizontally, and thus, the width (or diameter) in the horizontal direction is sufficiently larger than the vertical height. The first rotation plate 10 coupled to the body 50 may be parallel to the floor surface B, or may form an inclination with the floor surface B.

The first rotation plate 10 may be formed in a circular plate shape, the bottom surface of the first rotation plate 10 may be generally circular.

The first rotation plate 10 may be formed in a rotationally symmetrical shape as a whole.

In the robot cleaner 1, the bottom surface of the first rotation plate 10 coupled to the body 50 may form a predetermined inclination with the floor surface B, and in this case, the rotation shaft 15 of the first rotation plate 10 may form a predetermined inclination with a direction perpendicular to the floor surface B.

The second rotation plate 20 is made to have a predetermined area, and is formed in the form of a flat plate, a flat frame and the like. The second rotation plate 20 is generally laid horizontally, and thus, the horizontal width (or diameter) is sufficiently larger than the vertical height. The second rotation plate 20 coupled to the body 50 may be parallel to the floor surface B, or may be inclined with the floor surface B.

The second rotation plate 20 may be formed in a circular plate shape, the bottom surface of the second rotation plate 20 may be substantially circular.

The second rotation plate 20 may have a rotationally symmetrical shape as a whole In the robot cleaner 1 according to an embodiment of the present invention, the bottom surface of the second rotation plate 20 coupled to the body 50 may form a predetermined inclination with the floor surface B, and in this case, the rotation shaft 25 of the second rotation plate 20 may form a predetermined inclination with a direction perpendicular to the floor surface B.

In the robot cleaner 1, the second rotation plate 20 may be the same as the first rotation plate 10, or may be symmetrically formed. If the first rotation plate 10 is located on the left side of the robot cleaner 1, the second rotation plate 20 may be located on the right side of the robot cleaner 1, and in this case, the first rotation plate 10 and the second rotation plate 20 can be symmetrical to each other.

The first mop 30 has a bottom surface facing the floor surface of the space to be cleaned to have a predetermined area, and the first mop 30 has a flat shape. The first mop 30 is formed in a form in which the width (or diameter) in the horizontal direction is sufficiently larger than the height in the vertical direction. When the first mop 30 is coupled to the body 50, the bottom surface of the first mop 30 may be parallel to the floor surface B, or may be inclined with the floor surface B.

The bottom surface of the first mop 30 may form a substantially circular shape.

The first mop 30 may be formed in a rotationally symmetrical shape as a whole.

The first mop 30 may be made of various materials that can wipe the floor while in contact with the floor. To this end, the bottom surface of the first mop 30 may be made of a cloth made of a woven or knitted fabric, a nonwoven fabric, and/or a brush having a predetermined area, and the like.

In the robot cleaner 1, the first mop 30 is detachably attached to the lower side of the first rotation plate 10, and coupled to the first rotation plate 10 to rotate together with the first rotation plate 10.

As the first mop 30 is coupled to the first rotation plate 10, the first mop 30 and the first rotation plate 10 may be coupled to each other in an overlapping form, and the first mop 30 may be coupled to the first rotation plate 10 so that the center of the first mop 30 coincides with the center of the first rotation plate 10.

The second mop 40 has a bottom surface facing the floor surface of the space to be cleaned to have a predetermined area, and the second mop 40 has a flat shape. The second mop 40 is formed in a form in which the width (or diameter) in the horizontal direction is sufficiently larger than the height in the vertical direction. When the second mop 40 is coupled to the body 50, the bottom surface of the second mop 40 may be parallel to the floor surface B, or may be inclined with the floor surface B.

The bottom surface of the second mop 40 may form a substantially circular shape.

The second mop 40 may have a rotationally symmetrical shape as a whole.

The second mop 40 may be made of various materials that can wipe the floor while in contact with the floor. To this end, the bottom surface of the second mop 40 may be made of a cloth made of woven or knitted fabric, a non-woven fabric, and/or a brush having a predetermined area and the like.

In the robot cleaner 1 according to an embodiment of the present invention, the second mop 40 may be detachably attached to the bottom surface of the second rotation plate 20, and coupled to the second rotation plate 20 to rotate together with the second rotation plate 20.

As the second mop 40 is coupled to the second rotation plate 20, the second mop 40 and the second rotation plate 20 may be coupled to each other in an overlapping form, and the second mop 40 may be coupled to the second rotation plate 20 so that the center of the second mop 40 coincides with the center of the second rotation plate 20.

The robot cleaner 1 may be configured to move straight along the floor surface B. For example, the robot cleaner 1 may move straight forward (X direction) when cleaning, or may move straight backward when it is necessary to avoid obstacles or cliffs.

In the robot cleaner 1, the first rotation plate 10 and the second rotation plate 20 may be inclined with the floor surface B, respectively, so that the side closer to each other is more spaced apart from the floor surface B than the side farther from each other. That is, the first rotation plate 10 and the second rotation plate 20 may be formed so that the side farther from the center of the robot cleaner 1 is located closer to the floor than the side closer to the center of the robot cleaner 1. (Refer to FIG. 2*c*).

When the first rotation plate 10 and the second rotation plate 20 rotate in opposite directions at the same speed, the robot cleaner 1 may move in a linear direction, and move forward or backward. For example, when viewed from above, when the first rotation plate 10 rotates counterclockwise and the second rotation plate 20 rotates clockwise, the robot cleaner 1 may move forward.

When only one of the first rotation plate 10 and the second rotation plate 20 rotates, the robot cleaner 1 may change direction and turn around.

When the rotation speed of the first rotation plate 10 and the rotation speed of the second rotation plate 20 are different from each other, or when the first rotation plate 10 and the second rotation plate 20 rotate in the same direction, the robot cleaner 1 can move while changing direction, and move in a curved direction.

The robot cleaner 1 may further include a first support wheel 51, a second support wheel 52, and a first lower sensor 123.

The first support wheel 51 and the second support wheel 52 may be configured to contact the floor together with the first mop 30 and the second mop 40.

The first support wheel 51 and the second support wheel 52 are spaced apart from each other, and each may be formed in the same shape as a conventional wheel. The first support wheel 51 and the second support wheel 52 may move while rolling in contact with the floor, and accordingly, the robot cleaner 1 may move along the floor surface B.

The first support wheel 51 may be coupled to the bottom surface of the body 50 at a point spaced apart from the first rotation plate 10 and the second rotation plate 20, and the second support wheel 52 may be also coupled to the bottom surface of the body 50 at a point spaced apart from the first rotation plate 10 and the second rotation plate 20.

When a virtual line connecting the center of the first rotation plate 10 and the center of the second rotation plate 20 in a horizontal direction (a direction parallel to the floor surface B) is referred to as a connection line L1, the second support wheel 52 is located on the same side as the first support wheel 51 based on the connection line L1, and in this case, an auxiliary wheel 53 to be described later is located on the other side from the first support wheel 51 based on the connection line L1.

The interval between the first support wheel 51 and the second support wheel 52 may be made in a relatively wide form, considering the overall size of the robot cleaner 1. More specifically, in a state in which the first support wheel 51 and the second support wheel 52 are placed on the floor surface B (in a state in which the rotation shaft 51*a* of the first support wheel 51 and the rotation shaft 52*a* of the second support wheel 52 are parallel to the floor surface B), the first support wheel 51 and the second support wheel 52 may be formed to have the interval sufficient to stand upright without falling sideways while supporting a portion of the load of the robot cleaner 1.

The first support wheel 51 may be located in front of the first rotation plate 10, and the second support wheel 52 may be located in front of the second rotation plate 20

The first lower sensor 123 is formed on the lower side of the body 50, and is configured to detect a relative distance to the floor surface B. The first lower sensor 123 may be formed in various ways within a range capable of detecting the relative distance between the point where the first lower sensor 123 is formed and the floor surface B.

When the relative distance (which may be a distance in a vertical direction from the floor surface, or a distance in an inclined direction from the floor surface) to the floor surface B, detected by the first lower sensor 123 exceeds a predetermined value or a predetermined range, it may be the case in which the floor surface may be suddenly lowered, and accordingly, the first lower sensor 123 may detect a cliff.

The first lower sensor 123 may be formed of a photosensor, and may be configured to include a light emitting unit for irradiating light and a light receiving unit through which the reflected light is incident. The first lower sensor 123 may be an infrared sensor.

The first lower sensor 123 may be referred to as a cliff sensor.

The first lower sensor 123 is formed on the same side as the first support wheel 51 and the second support wheel 52 based on the connection line L1.

The first lower sensor 123 is located between the first support wheel 51 and the second support wheel 52 along the outline direction of the body 50. In the robot cleaner 1, if the first support wheel 51 is located on the relatively left side and the second support wheel 52 is located on the relatively right side, the first lower sensor 123 is generally located in the middle.

The first lower sensor 123 is formed further forward of the support wheels 51 and 52.

When the first lower sensor 123 is formed on the lower surface of the body 50, the first lower sensor 123 may be formed at a point sufficiently spaced apart from the first rotation plate 10 and the second rotation plate 20 (and also a point spaced sufficiently spaced apart from the first mop 30 and the second mop 40), such that the detection of the cliff by the first lower sensor 123 is not interrupted by the first mop 30 and the second mop 40, and also, a cliff located in front of the robot cleaner 1 is quickly detected. Accordingly, the first lower sensor 123 may be formed adjacent to the outline of the body 50.

The robot cleaner 1 may be configured such that operation is controlled according to the distance sensed by the first lower sensor 123. More specifically, according to the distance sensed by the first lower sensor 123, the rotation of one or more of the first rotation plate 10 and the second rotation plate 20 may be controlled. For example, when the distance sensed by the first lower sensor 123 exceeds a predetermined value or out of a predetermined range, the rotation of the first rotation plate 10 and the second rotation plate 20 is stopped, and then the robot cleaner 1 is stopped, or the direction of rotation of the first rotation plate 10 and/or the second rotation plate 20 is changed, and then the moving direction of the robot cleaner 1 is changed.

The direction detected by the first lower sensor 123 may be inclined downward toward the outline of the body 50. For example, when the first lower sensor 123 is a photosensor, the direction of the light irradiated by the first lower sensor 123 is not perpendicular to the floor surface B, but may be inclined toward the front.

Accordingly, the first lower sensor 123 may detect a cliff located further in front of the first lower sensor 123 and detect a cliff located relatively in the front of the body 50, and the robot cleaner 1 can be prevented from entering the cliff.

The robot cleaner 1 can change the direction to the left or right during cleaning, and can move in a curved direction, in which case the first mop 30, the second mop 40, the first support wheel 51 and the second support wheel 52 contact the floor and support the load of the robot cleaner 1.

When the robot cleaner 1 moves while changing the direction to the left, the cliff may be detected by the first lower sensor 123 before the first support wheel 51 and the second support wheel 52 enters the cliff, the cliff may be detected by the first lower sensor 123 at least before the second support wheel 52 enters the cliff. When the detection of the cliff is made by the first lower sensor 123, the load of robot cleaner 1 may be supported by the first mop 30, the second mop 40, the first support wheel 51 and the second support wheel 52, or by at least the first mop 30, the second mop 40, and the second support wheel 52.

When the robot cleaner 1 moves while changing the direction to the right, the cliff may be detected by the first lower sensor 123 before the first support wheel 51 and the second support wheel 52 enter the cliff. In addition, the cliff may be detected by the first lower sensor 123 at least before the first support wheel 51 enters the cliff. When the detection of the cliff is made by the first lower sensor 123, the load of the robot cleaner 1 may be supported by the first mop 30, the second mop 40, the first support wheel 51 and the second support wheel 52, or by at least the first mop 30, the second mop 40 and the first support wheel 51.

Accordingly, even when the robot cleaner 1 moves straight ahead as well as when changing the direction, the detection of the cliff can be made by the first lower sensor before the first support wheel 51 and the second support wheel 52 enter the cliff, this can prevent the robot cleaner 1 from falling to a cliff, and the overall balance of the robot cleaner 1 from being broken.

The robot cleaner 1 may further include a second lower sensor 124 and a third lower sensor 125.

The second lower sensor 124 and the third lower sensor 125 are formed on the lower side of the body 50 on the same side as the first support wheel 51 and the second support wheel 52 based on the connection line L1, and they are configured to sense the relative distance to the floor B.

When the second lower sensor 124 is formed on the lower surface of the body 50, the second lower sensor 124 is formed to be spaced apart from the first mop 30 and the second mop 40 such that the detection of the cliff by the second lower sensor 124 is not interrupted by the first mop 30 and the second mop 40. In addition, in order to quickly detect the cliff located on the left or right side of the robot cleaner 1, the second lower sensor 124 may be formed at a point spaced outwardly from the first support wheel 51 or the second support wheel 52. The second lower sensor 124 may be formed adjacent to the outline of the body 50.

The second lower sensor 124 may be formed opposite to the first lower sensor 123 based on to the first support wheel 51. Accordingly, the detection of the cliff on either side of the first support wheel 51 may be made by the first lower sensor 123, the detection of the cliff on the other side may be made by the second lower sensor 124, and the detection of the cliff in the vicinity of the first support wheel 51 can be made effectively.

When the third lower sensor 125 is formed on the lower surface of the body 50, the third lower sensor 125 is formed to be spaced apart from the first mop 30 and the second mop 40 such that the detection of the cliff by the third lower sensor 125 is not interrupted by the first mop 30 and the second mop 40. In addition, in order to quickly detect the cliff located on the left or right side of the robot cleaner 1, the second lower sensor 124 may be formed at a point spaced outwardly from the first support wheel 51 or the second support wheel 52. The second lower sensor 124 may be formed adjacent to the outline of the body 50.

The third lower sensor 125 may be formed opposite to the first lower sensor 123 based on the second support wheel 52. Accordingly, the detection of the cliff on either side of the second support wheel 52 is made by the first lower sensor 123, and the detection of the cliff on the other side can be made by the second lower sensor 124. And, the detection of the cliff in the vicinity of the second support wheel 52 can be made effectively.

Each of the second lower sensor 124 and the third lower sensor 125 may be formed in various ways within a range capable of detecting a relative distance to the floor surface B. Each of the second lower sensor 124 and the third lower sensor 125 may be formed in the same manner as the above-described first lower sensor 123, except for a location where it is formed.

The robot cleaner 1 may be configured such that its operation is controlled according to the distance sensed by the second lower sensor 124. More specifically, according to the distance sensed by the second lower sensor 124, the rotation of any one or more of the first rotation plate 10 and the second rotation plate 20 may be controlled. For example, when the distance detected by the second lower sensor 124 exceeds a predetermined value or out of a predetermined range, the rotation of the first rotation plate 10 and the second rotation plate 20 is stopped, and then the robot cleaner 1 is stopped, or the direction of rotation of the first rotation plate 10 and/or the second rotation plate 20 is changed, and then the moving direction of the robot cleaner 1 is changed.

The robot cleaner 1 may be configured such that its operation is controlled according to the distance sensed by the third lower sensor 125. More specifically, according to the distance sensed by the third lower sensor 125, the rotation of any one or more of the first rotation plate 10 and the second rotation plate 20 may be controlled. For example, when the distance detected by the third lower sensor 125 exceeds a predetermined value or out of a predetermined range, the rotation of the first rotation plate 10 and the second rotation plate 20 is stopped, and then the robot cleaner 1 is stopped, or the direction of rotation of the first rotation plate 10 and/or the second rotation plate 20 is changed, and then the moving direction of the robot cleaner 1 is changed.

The distance from the connection line L1 to the second lower sensor 124 and the distance from the connection line L1 to the third lower sensor 125, may be formed to be shorter than the distance from the connection line L1 to the first support wheel 51 and the distance form the connection line L1 to the second support wheel 52.

In addition, the second lower sensor 124 and the third lower sensor 125 are located outside the rectangular vertical region where each vertex is the center of the first rotation plate 10, the center of the second rotation plate 20, the center of the first support wheel 51, and the center of the second support.

When the second lower sensor 124 is located on the left side of the robot cleaner 1, the third lower sensor 125 may be located on the right side of the robot cleaner 1.

The second lower sensor 124 and the third lower sensor 125 may be symmetrical to each other.

The robot cleaner 1 may be configured to include an auxiliary wheel 53 together with the first support wheel 51 and the second support wheel 52.

The auxiliary wheel 53 may be spaced apart from the first rotation plate 10 and the second rotation plate 20, and coupled to the lower side of the body 50. The auxiliary wheel 53 is located on the other side from the first support wheel 51 and the second support wheel 52 based on the connection line L1.

Meanwhile, the robot cleaner 1 may further include a first actuator 56, a second actuator 57, a battery 135, a water container 141, and a water supply tube 142.

The first actuator 56 is coupled to the body 50 to provide power to rotate the first rotation plate 10. The first actuator 56 may include a first motor and one or more first gears. The first motor may be an electric motor. The plurality of first gears is formed to rotate while interlocking with each other, connect the first motor and the first rotation plate 10, and transmit the rotational power of the first motor to the first rotation plate 10. Accordingly, when the rotation shaft of the first motor rotates, the first rotation plate 10 rotates.

The second actuator 57 is coupled to the body 50 to provide power to rotate the second rotation plate 20. The second actuator 57 may include a second motor and one or more second gears. The second motor may be an electric motor. The plurality of second gears is formed to rotate while interlocking with each other, connect the second motor and the second rotation plate 20, and transmit the rotational power of the second motor to the second rotation plate 20. Accordingly, when the rotation shaft of the second motor rotates, the second rotation plate 20 rotates.

In the robot cleaner 1, the first rotation plate 10 and the first mop 30 may be rotated by the operation of the first actuator 56, and the second rotation plate 20 and the second mop 40 may be rotated by the operation of the second actuator 57.

The second actuator 57 may form a symmetry (left and right symmetry) with the first actuator 56.

The battery 135 is configured to be coupled to the body 50 to supply power to other components constituting the robot cleaner 1. The battery 135 may supply power to the first actuator 56 and the second actuator 57, and in particular, supply power to the first motor and the second motor.

The battery 135 may be charged by an external power source, and for this purpose, a charging terminal for charging the battery 135 may be provided on one side of the body 50 or the battery 135 itself. The battery 135 may be coupled to the body 50.

The water container 141 is made in the form of a container having an internal space so that a liquid such as water is stored therein. The water container 141 may be fixedly coupled to the body 50, or detachably coupled to the body 50.

The water container 141 may be located on an upper side of the auxiliary wheel 53.

The water supply tube 142 is formed in the form of a tube or pipe, and is connected to the water container 141 so that the liquid inside the water container 141 flows through the inside thereof. The water supply tube 142 is configured such that the opposite end connected to the water container 141 is located on the upper side of the first rotation plate 10 and the second rotation plate 20, and accordingly, the liquid inside the water container 141 can be supplied to the mop 30 and the second mop 40.

In the robot cleaner 1, the water supply tube 142 may be formed in a form in which one tube is branched into two, in this case, one branched end is located on the upper side of the first rotation plate 10, and the other branded end is located on the upper side of the second rotation plate 20.

In the robot cleaner 1, a water pump 143 may be provided to move the liquid through the water supply tube 142.

In addition, the robot cleaner 1 may be configured to further include a bumper 58, a collision detection sensor 121, and a distance sensor 122.

The bumper 58 is coupled along the outline of the body 50, and is configured to move relative to the body 50. For example, the bumper 58 may be coupled to the body 50 so as to reciprocate along a direction approaching the center of the body 50.

The bumper 58 may be coupled along a portion of the outline of the body 50, or may be coupled along the entire outline of the body 50.

The collision detection sensor 121 may be coupled to the body 50 and configured to detect a movement (relative movement) of the bumper 58 with respect to the body 50. The collision detection sensor 121 may be formed using a micro switch, a photo interrupter, a tact switch and the like.

The distance sensor 122 may be coupled to the body 50 and configured to detect a relative distance to an obstacle.

The robot cleaner 1 can be moved (driven) by a friction force between the first mop 30 and the floor surface B generated when the first rotation plate 10 is rotated, and a frictional force between the second mop 40 and the floor surface B generated when the second rotation plate 20 is rotated.

In the robot cleaner 1, the first support wheel 51 and the second support wheel 52 may be made to such an extent that the movement (driving) of the robot cleaner 1 is not obstructed by the frictional force with the floor, and a load is not increased when the robot cleaner 1 moves (drives).

FIG. 3 is a block diagram of a robot cleaner according to an embodiment of the present invention.

Referring to FIG. 3, the robot cleaner 1 includes a control unit 110, a sensor unit 120, a power unit 130, a water supply unit 140, a driving unit 150, a communication unit 160, a display unit 170 and a memory 180.

The components shown in the block diagram of FIG. 3 are not essential for implementing the robot cleaner 1, so the robot cleaner 1 described in the present specification can have more or fewer components than those listed above.

First, the control unit 110 may be connected to the external control device 5 through wireless communication by a communication unit 160 to be described later. In this case, the control unit 110 may transmit various data about the robot cleaner 1 to the connected external control device 5. And, it is possible to receive data from the connected external control device 5 and store it. Here, the data input from the external control device 5 may be a control signal for controlling at least one function of the robot cleaner 1.

In other words, the robot cleaner 1 may receive a control signal based on a user input from the external control device 5 and operate according to the received control signal.

In addition, the control unit 110 may control the overall operation of the robot cleaner. The control unit 110 controls the robot cleaner 1 to autonomously drive a surface to be cleaned and perform a cleaning operation according to the set information stored in the memory 180 to be described later.

The sensor unit 120 may be coupled to the body 50 of the robot cleaner 1 and may include at least one sensor for detecting the distance data of the space to be cleaned.

The sensor unit 120 may detect the environment around the space to be cleaned, and the information on the environment around the robot cleaner 1 detected by the sensor unit 120 may be transmitted to the external control device 5 by the control unit 110. Here, the information on the environment may be, for example, whether an obstacle exists, whether a cliff is detected, whether a collision is detected, and the like.

The sensor unit 120 may include a lower sensor for detecting the height between the floor surface B and the lower side of the robot cleaner 1 in the space to be cleaned as the distance data.

In this case, the lower sensor includes at least one of the first lower sensor 123, the second lower sensor 124, and the third lower sensor 125 of the robot cleaner 1 described above.

According to the distance data detected by the first lower sensor 123, the second lower sensor 124, or the third lower sensor 125, the control unit 110 may control the operation of the first actuator 56 and/or the second actuator 57 such that the robot cleaner 1 stops or changes the driving direction.

In addition, the sensor unit 120 may include the collision detection sensor 121 for detecting the collision of the robot cleaner 1.

Also, the sensor unit 120 may include a distance sensor 122 that detects a relative distance between the robot cleaner 1 and an obstacle (for example, a wall surface) as the distance data.

According to the distance data information detected by the distance sensor 122, when the distance between the robot cleaner 1 and the obstacle is less than or equal to a predetermined value, the control unit 110 may control the operation of the first actuator 56 and/or the second actuator 57 such that the driving direction of the robot cleaner 1 is changed or the robot cleaner 1 stops or the robot cleaner 1 moves away from the obstacle.

Meanwhile, in the robot cleaner 1 according to an embodiment of the present invention, when receiving the user input setting a reference distance for detecting the surrounding environment of the space to be cleaned through the external control device 5, the control unit 110 may control the operation of the first actuator 56 and the second actuator 57 based on the distance data detected by the sensor unit 120 and the reference distance.

For example, the reference distance set by the user input may be a height of cliff.

In this case, in a state in which the height of cliff is set as the reference distance, the control unit 110 may change the height of cliff to the set height of cliff when a preset reference height of cliff in the robot cleaner 1 is less than the height of cliff set by the user input.

Through this, the user may reset the reference height of cliff, which is a reference for determining whether it is a cliff, to the height of cliff directly set by the user.

Also, the control unit 110 may determine that the cliff has been detected when the distance data detected by the lower sensors 123, 124, and 125 is greater than the reference height of cliff while the robot cleaner is performing the cleaning operation.

When it is determined that the control unit 110 detects the cliff, the control unit 110 controls the first actuator 56 and the second actuator 57 so that the robot cleaner 1 performs an avoidance operation to avoid the cliff.

On the other hand, the control unit 110 may receive the user input selecting one or more areas among the space to be cleaned having a plurality of divided areas, and the user input setting a height of cliff corresponding to each of the selected areas through the external control device 5.

More specifically, the plurality of divided areas may be divided areas such as a living room, a master bedroom, a kitchen and the like. For example, the user may select a living room among the plurality of divided areas of the space to be cleaned through the external control device 5, and set a desired height as a height of cliff corresponding to the living room.

When the robot cleaner 1 enters the selected area while performing a cleaning operation, the control unit 110 may compare a preset reference height of cliff of the selected area with the height of cliff set by the user input in response to the selected area.

Also, as a result of the comparison, when the reference height of cliff is less than the set height of cliff, the control unit 110 may change the reference height of cliff to the set height of cliff.

Through this, the user may differently reset the reference height of cliff, which is a reference for determining whether a cliff is present, in each of the divided areas.

Also, when the distance data detected by the lower sensors 123, 124, and 125 is greater than the reference height of cliff while the cleaning operation is being performed, the control unit 110 may determine that the cliff is detected.

If it is determined that the cliff is detected, the control unit 110 may control the first actuator 56 and the second actuator 57 to perform an avoidance operation to avoid the cliff.

Here, the avoidance operation may be to control the first actuator 56 and the second actuator 57 so that only one of the first rotation plate 10 and the second rotation plate 20 rotates by the control unit 110.

When any one of the first rotation plate 10 and the second rotation plate 20 rotates and the other rotation plate does not rotate, the driving direction of the robot cleaner 1 may be run awry by a predetermined angle based on the driving direction.

Through this, since the direction of the robot cleaner 1 can be changed, the robot cleaner 1 can be moved away from the cliff detected in the front of the moving direction.

Alternatively, the avoidance operation may be to control the first actuator 56 and the second actuator 57 so that the first rotation plate 10 and the second rotation plate 20 respectively rotate in an opposite direction to the rotation direction up to that time by the control unit 110.

In this case, the driving direction of the robot cleaner 1 is changed to a direction opposite to the direction in which the robot cleaner 1 is moving.

That is, the robot cleaner 1 can avoid the cliff by changing the driving direction backward, without continuing to drive in the direction of the cliff detected in the front of the moving direction. Changing the driving direction to backward means that the robot cleaner 1 drives in a direction in which the rear of the robot cleaner 1 faces, not in a direction in which the front of the robot cleaner 1 faces.

Through this, since the robot cleaner 1 can move backward, it is possible to move the robot cleaner 1 away from the cliff detected in the front of the moving direction.

Alternatively, the avoidance operation may be to control the first actuator 56 and the second actuator 57 so that the first rotation plate 10 and the second rotation plate 20 stop rotating by the control unit 110.

Through this, it is possible to stop the robot cleaner 1 before falling to the cliff detected from the front.

Meanwhile, the reference distance set by the user input may be a wall distance that is a distance from an obstacle.

In a state where the wall distance is set as the reference distance, when a preset wall reference distance is less than the wall distance set by the user input, the control unit 110 may change the wall reference distance to the set wall distance.

Through this, the user may reset the wall reference distance, which is a reference for determining whether an obstacle exists, to the wall distance directly set by the user.

Also, when the distance data detected by the distance sensor 122 is greater than the wall reference distance while the cleaning operation is being performed, the control unit 110 may determine that a wall or an obstacle is detected.

When it is determined that the control unit 110 detects a wall or an obstacle, the control unit 110 controls the first actuator 56 and the second actuator 57 to perform the collision avoidance operation that avoids a collision with the obstacle.

Here, the collision avoidance operation may be to control the first actuator 56 and the second actuator 57 so that only one of the first rotation plate 10 and the second rotation plate 20 rotates by the control unit 110.

When any one of the first rotation plate 10 and the second rotation plate 20 rotates and the other rotation plate does not rotate, the moving direction of the robot cleaner 1 may be run awry by a predetermined angle based on the moving direction.

Through this, since the direction of the robot cleaner 1 can be changed, the robot cleaner 1 can be moved away from the obstacle detected in front of the moving direction.

Alternatively, the collision avoidance operation may be to control the first actuator 56 and the second actuator 57 so that the first rotation plate 10 and the second rotation plate 20 respectively rotate in an opposite direction to the rotation direction up to that time by the control unit 110.

In this case, the driving direction of the robot cleaner 1 is changed to a direction opposite to the direction in which the robot cleaner 1 is moving.

That is, the robot cleaner 1 may avoid collision with the obstacle by changing the driving direction to the backward without continuing to drive in the direction of the obstacle detected in the front of the moving direction. Changing the driving direction to the backward means that the robot cleaner 1 drives in a direction in which the rear of the robot cleaner 1 faces, not in a direction in which the front of the robot cleaner 1 faces.

Through this, since the robot cleaner 1 can move backward, it is possible to move the robot cleaner 1 away from the obstacle detected in the front of the moving direction.

Meanwhile, the power unit 130 receives external power and internal power under the control of the control unit 110 to supply power required for operation of each component. The power unit 130 may include the battery 135 of the robot cleaner 1 described above.

The driving unit 150 may be formed such that the robot cleaner 1 rotates or moves in a straight line according to a control signal of the control unit 110, and it may include the first actuator 56 and the second actuator 57 of the robot cleaner 1 described above.

Meanwhile, the communication unit 160 may include at least one module that enables wireless communication between the robot cleaner 1 and a wireless communication system, or between the robot cleaner 1 and a preset peripheral device, or between the robot cleaner 1 and a preset external server.

In this case, the preset peripheral device may be the external control device 5 of the robot cleaning system according to an embodiment of the present invention.

For example, the at least one module may include at least one of an IR (Infrared) module for infrared communication, an ultrasonic module for ultrasonic communication, or a short-range communication module such as a WiFi module or a Bluetooth module. Alternatively, it may be formed to transmit/receive data to/from a preset device through various wireless technologies such as wireless LAN (WLAN) and wireless-fidelity (Wi-Fi), including wireless internet module.

Meanwhile, the display unit 170 displays information to be provided to a user. For example, the display unit 170 may include a display for displaying a screen.

The display unit 170 may include a speaker for outputting a sound. The source of the sound output by the speaker may be sound data prestored in the robot cleaner 1. For example, the prestored sound data may be about a voice guidance corresponding to each function of the robot cleaner 1 or a warning sound for notifying an error.

In addition, the display unit 170 may be formed of any one of a light emitting diode (LED), a liquid crystal display (LCD), a plasma display panel, and an organic light emitting diode (OLED).

Lastly, the memory 180 may include various data for driving and operating the robot cleaner 1. The memory 180 may include an application program for autonomous driving of the robot cleaner 1 and various related data. In addition, each distance data sensed by the sensor unit 120 may be stored, and the information on various settings (values) selected or input by the user (for example, the height of the cliff set by a user input, the wall distance set by a user input, etc.) may be included.

Meanwhile, the memory 180 may include information on the space to be cleaned currently given to the robot cleaner 1. For example, the information on the space to be cleaned may be map information mapped by the robot cleaner 1 by itself. And the map information, that is, the map may include various information set by the user for each area constituting the space to be cleaned.

FIG. 4 is an internal block diagram of the external control device 5 of FIG. 1.

Referring to FIG. 4, the external control device 5 may include a server, a wireless communication unit 510 for exchanging data with other electronic devices such as the robot cleaner 1, and a control unit 580 that controls the screen of the application to be displayed on the display unit 551 according to a user input executing the application for controlling the robot cleaner 1.

In addition, the external control device 5 may further include an A/V (Audio/Video) input unit 520, a user input unit 530, a sensing unit 540, an output unit 550, a memory 560, an interface unit 570 and a power supply unit 590.

Meanwhile, the wireless communication unit 510 may receive location information and status information directly from the robot cleaner 1, or may receive location information and status information of the robot cleaner 1 through a server.

Meanwhile, the wireless communication unit 510 may include a broadcast reception module 511, a mobile communication module 513, a wireless internet module 515, a short-range communication module 517, a GPS module 519 and the like.

The broadcast reception module 511 may receive at least one of a broadcast signal and broadcast related information from an external broadcast management server through a broadcast channel. In this case, the broadcast channel may include a satellite channel, a terrestrial channel, and the like.

The broadcast signal and/or broadcast related information received through the broadcast reception module 511 may be stored in the memory 560.

The mobile communication module 513 transmits/receives wireless signals to and from at least one of a base station, an external terminal, and a server on a mobile communication network. Here, the wireless signal may include various types of data according to transmission/reception of a voice call signal, a video call call signal, or text/multimedia message.

The wireless internet module 515 refers to a module for wireless internet access, and the wireless internet module 515 may be built-in or external to the external control device 5 for controlling the robot cleaner 1. For example, the wireless internet module 515 may perform WiFi-based wireless communication or WiFi Direct-based wireless communication.

The short-range communication module 517 is for short-range communication, and may support short-range communication using at least one of Bluetooth™, Radio Frequency Identification (RFID), Infrared Data Association (IrDA), Ultra Wideband (UWB), ZigBee, Near Field Communication (NFC), Wireless-Fidelity (Wi-Fi), Wi-Fi Direct, and Wireless Universal Serial Bus (Wireless USB) technologies.

The short-distance communication module 517 may support wireless communication between the external control device 5 for controlling the robot cleaner 1 through a short-range wireless communication network (Wireless Area Networks) and a wireless communication system, between the external control device 5 and the external control device of another robot cleaner, or between the external control device 5 and another mobile terminal, or between networks in which an external server is located. The short-range wireless communication network may be Wireless Personal Area Networks.

The Global Position System (GPS) module 519 may receive location information from a plurality of GPS satellites.

Meanwhile, the wireless communication unit 510 may exchange data with a server using one or more communication modules.

The wireless communication unit 510 may include an antenna 505 for wireless communication, and may include an antenna for receiving a broadcast signal in addition to an antenna for a call and the like.

The A/V (Audio/Video) input unit 520 is for inputting an audio signal or a video signal, and may include a camera 521, a microphone 523, and the like.

The user input unit 530 generates key input data input by a user to control the operation of the external control device 5. To this end, the user input unit 530 may include a key pad, a dome switch, a touch pad (static pressure/capacitive), and the like. In particular, when the touch pad forms a mutual layer structure with the display unit 551, it may be referred to as a touch screen.

The sensing unit 540 may generate a sensing signal for controlling the operation of the external control device 5 by detecting the current status of the external control device 5 such as the opening/closing status of the external control device 5, the location of the external control device 5, the presence or absence of user contact, and the like.

The sensing unit 540 may include a proximity sensor 541, a pressure sensor 543, a motion sensor 545, and the like. The motion sensor 545 may detect a motion or location of the external control device 5 using an acceleration sensor, a gyro sensor, a gravity sensor, and the like. In particular, the gyro sensor is a sensor for measuring angular velocity, and may detect a direction (angle) that is turned with respect to a reference direction.

The output unit 550 may include a display unit 551, a sound output module 553, an alarm unit 555, a haptic module 557 and the like.

On the other hand, when the display unit 551 and the touch pad form a mutual layer structure and are configured as a touch screen, the display unit 551 may be used as an input device capable of inputting information by a user's touch in addition to an output device.

That is, the display unit 551 may serve to receive information by a user's touch input, and at the same time, may also serve to display the information processed by the control unit 580, which will be described later.

A control screen for receiving a user input related to a control signal for controlling the robot cleaner 1 may be displayed on the display unit 551. Here, the information on the status of the robot cleaner 1 received through the wireless communication unit 510 may be displayed on the control screen.

The sound output module 553 outputs audio data received from the wireless communication unit 510 or stored in the memory 560. The sound output module 553 may include a speaker, a buzzer, and the like.

The alarm unit 555 may output a signal for notifying the occurrence of an event in the external control device 5. For example, the signal may be output in a form of vibration.

The haptic module 557 generates various tactile effects that a user can feel. A representative example of the tactile effect generated by the haptic module 557 is a vibration effect.

The memory 560 may store a program for processing and control of the control unit 580, and perform a function for temporary storage of input or output data (for example, phonebook, message, still image, video, etc.).

The interface unit 570 functions as an interface with all external devices connected to the external control device 5. The interface unit 570 may receive data or power from such an external device and transmit it to each component inside the external control device 5, and allow the data inside the external control device 5 to be transmitted to an external device (for example, it may be transmitted to the robot cleaner 1).

The control unit 580 controls the overall operation of the external control device 5 by generally controlling the operations of the respective units. For example, it may perform related control and processing for voice calls, data communications, video calls, and the like. In addition, the control unit 580 may include a multimedia playback module 581 for playing multimedia. The multimedia playback module 581 may be configured as a hardware in the control unit 580 or may be configured as a software separately from the control unit 580.

In addition, the control unit 580 may display a control screen for controlling the robot cleaner 1 on the display unit 551, switch the control screen to another control screen according to a user's touch input, and transmit data corresponding to the user input inputted through the display unit 551 to the robot cleaner 1.

FIGS. 5*a* to 6 are examples of the control screen of the external control device 5.

Hereinafter, a case in which the reference distance set by the user is the height of cliff will be described as an example with reference to FIGS. 5*a* to 6. However, it should be noted that the present invention is not limited thereto.

That is, in addition to the height of cliff, the wall distance may be set as the reference distance set by the user through the external control device 5.

FIGS. 5*a* and 5*b* are views illustrating an example of a control screen of an external control device for setting a height of cliff.

Referring to 5*a* and 5*b*, the control unit 580 may display a plurality of height of cliff items C11 and C12 selectable by the user's touch input on the control screen of the external control device 5.

More specifically, as shown in FIG. 5*a*, a fall prevention sensitivity set item C10 for setting a height of cliff may be displayed on the control screen. When the user touches and selects the fall prevention sensitivity set item C10, a plurality of height of cliff items C11 and C12 may be displayed in a form of a drop-down menu and expanded.

For example, as shown in FIG. 5*b*, the user can select between a "basic" mode item C11 and a "sensitive" mode item C12, and the "basic" mode item C11 is, for example, the item that is set to be determined as a cliff when the relative distance between the lower side of the robot cleaner 1 and the floor surface B is 30 mm or more. The "sensitive" mode item C12 is a case where the set value of the height of cliff is smaller than that of the "basic" mode, for example, the item is set to be determined as a cliff when the relative distance between the lower side of the robot cleaner 1 and the floor surface B is 15 mm or more.

Meanwhile, when the drop-down menu is expanded, a message explaining the set value of the height of cliff may be displayed in each of the items C11 and C12.

For example, as shown in FIG. 5*b*, in the "basic" mode item C11, the message "a fall is prevented when the difference in height of the floor is 30 mm or more" may be displayed. In addition, in the "sensitive" mode item C12, the message "a fall is prevented when the difference in height of the floor is 15 mm or more" may be displayed.

Due to this, the user can intuitively grasp the height of cliff set by the user.

In addition, the reference height of cliff may be set to the "basic" mode as a default.

Meanwhile, the control unit 580 may transmit information on the height of cliff corresponding to the selected height of cliff item to the robot cleaner 1.

Through this, the user may remotely select an appropriate set value of height of cliff for a cleaning environment.

FIG. 6 is a view illustrating an example of a control screen of an external control device for setting a height of cliff by selecting an area.

The control unit 110 may display an area selection item C20 together with the fall prevention sensitivity set item C30 on the control screen displayed on the display unit 551.

Since the configuration of the fall prevention sensitivity sett item C30 is the same as that of the fall prevention sensitivity set item C10 of FIG. 5*b*, a detailed description will be substituted for the above description.

In the area selection item C20, the map information of the space to be cleaned generated by the robot cleaner 1 in a previous cleaning operation may be displayed as an image. The space to be cleaned may include a plurality of areas, and such areas may be distinguishably displayed in the map information displayed as the image.

The user may first select one of the areas divided in the area selection item C20 by a touch input, and then select a set value of height of cliff corresponding to the selected area through the fall prevention sensitivity set item C10.

The control unit 580 may transmit information on the selected area and information on the height of cliff set corresponding to the selected area to the robot cleaner 1.

Through this, the user can remotely select different set values of height of cliff for each of a plurality of divided areas constituting the space to be cleaned.

As described above, the arrangement of the control screen described with reference to FIGS. 5*a* to 6 is an example, and the user may directly input the height of cliff numerically through the external control device 5. To this end, an input window for inputting the height of cliff may be displayed on the control screen of the external control device 5.

Meanwhile, the power supply unit 590 of the external control device 5 receives external power and internal power under the control of the control unit 580 to supply power required for operation of each component.

A block diagram of the external control device 5 shown in FIG. 4 is a block diagram for an embodiment of the present invention. Each component in the block diagram may be integrated, added, or omitted according to the specifications of the external control device 5 actually implemented.

That is, two or more components may be combined into one component, or one component may be subdivided into two or more components as needed. In addition, the function performed by each block is for explaining the embodiment of the present invention, and the specific operation or device does not limit the scope of the present invention.

Hereinafter, a control method of a robot cleaning system that can be implemented using the robot cleaner 1 and the external control device 5 configured as described above will be described with reference to the accompanying drawings.

FIG. 7 is a flowchart illustrating an example of setting a height of cliff in a robot cleaning system according to an embodiment of the present invention.

First, the control unit 110 of the robot cleaner 1 receives a user input through the external control device 5 (S110).

In this case, the user input is the height of cliff set by the user.

When the robot cleaner 1 starts a cleaning operation (S120), a preset reference height of cliff in the robot cleaner 1 is compared with the height of cliff set by the user input, and when the height of cliff set by the user input is less than the preset reference height of cliff, the reference height of cliff is changed to the set height of cliff (S130). If the reference height of cliff is less than or equal to the set height of cliff, the preset reference height of cliff is applied as it is and proceeds.

For example, assume that the robot cleaner 1 is located on a thin mattress and cleaning starts. The user can set the height of cliff as the thickness of the mattress, 15 mm, through the external control device 5. If the preset reference height of the cliff (for example, 30 mm) is greater than 15 mm, the reference height of the cliff is reset to 15 mm and changed. If the preset reference height of the cliff is less than or equal to 15 mm, the reference height of the cliff is not changed.

Thereafter, the control unit 110 detects that the reference height of the cliff is equal to or greater than the distance data detected by the lower sensors 123, 124, and 125, it is determined that a cliff is detected (S140).

The robot cleaner 1 drives autonomously while performing a cleaning operation, and the lower sensors 123, 124, and 125 continuously detect the relative distance between the lower side of the robot cleaner 1 and the floor surface B as distance data of the space to be cleaned. Then, when the distance data detected by the lower sensors 123, 124, and 125 is equal to or greater than the reference height of the cliff, the control unit 110 of the robot cleaner 1 determines that the cliff is detected.

For example, when the robot cleaner 1, which is driving on the mattress, drives to the vicinity of the edge of the mattress and detects distance data of 15 mm or more by the lower sensors 123, 124, and 125, the control unit 110 may determine that the cliff is detected.

If it is determined that the cliff is detected, the control unit 110 controls the first actuator 56 and the second actuator 57 to perform an avoidance operation to avoid the cliff (S150). Of course, while it is not determined that the cliff is detected, the avoidance operation is not performed, the process returns to step S140, and the cleaning operation is performed while driving continuously.

The avoidance operation may be to control the first actuator 56 and the second actuator 57 so that only one of the first rotation plate 10 and the second rotation plate 20 rotates as described above. In this case, only one of the first rotation plate 10 and the second rotation plate 20 rotates to change the driving direction of the robot cleaner 1.

Alternatively, the avoidance operation is to control the first actuator 56 and the second actuator 57 so that the first rotation plate 10 and the second rotation plate 20 rotate in an opposite direction to the rotation direction up to that time. In this case, the driving direction of the robot cleaner 1 is changed to the opposite direction to the direction in which the robot cleaner 1 is driving, so that the robot cleaner 1 may move backward.

Alternatively, the avoidance operation may be to control the first actuator 56 and the second actuator 57 so that the first rotation plate 10 and the second rotation plate 20 stop rotating.

In this case, the robot cleaner 1 stops driving and stops so as not to fall to the cliff.

For example, when a cliff is detected at the edge of the mattress, the control unit 110 controls the first actuator 56 and the second actuator 57 to make the robot cleaner 1 move backward or change the direction to the left or right or stop driving.

The above-described process ends when the cleaning operation is completed, and if the cleaning operation is not completed, the process returns to step S140 and continues to be repeated while cleaning (S160).

In this way, the user can set the height of cliff through the external control device 5, and based on this, the actuators 56 and 57 of the robot cleaner 1 can be controlled, so that it is possible to prevent in advance a situation in which the robot cleaner 1 is unable to drive depending on the environment of the cleaning space.

FIG. 8 is a flowchart illustrating an example of setting a height of cliff by selecting an area in a robot cleaning system according to an embodiment of the present invention.

First, the control unit 110 of the robot cleaner 1 receives a user input through the external control device 5 (S210).

In this case, the user input includes a user input selecting one or more areas of the space to be cleaned and a user input setting a height of cliff corresponding to each of the selected areas.

The space to be cleaned may be divided into a plurality of divided areas. In the memory 180 of the robot cleaner 1, the plurality of divided areas may be created and stored as map information based on data on the cleaning operation so far, and as described above, the control unit 110 may transmit the map information to the external control device 5 to be displayed on the control screen of the external control device 5 (Refer to FIG. 5*c*).

The user may select one or more areas among the plurality of divided areas through the external control device 5. In addition, the user may select one area and simultaneously set the height of cliff corresponding to the area.

For example, the user may select area No. 1 on the control screen of the external control device 5 as shown in FIG. 6. In addition, after selecting the area No. 1, the sensitive mode item C32 may be selected from the fall prevention sensitivity set item C30. In this case, the height of cliff is set to 15 mm.

When the cleaning operation of the robot cleaner 1 starts (S220), the control unit 110 determines whether the robot cleaner 1 enters the area selected by the user while the robot cleaner 1 is driving (S230).

For example, the control unit 110 may determine whether the selected area of the space to be cleaned is entered based on the currently generated map of the space to be cleaned, the driving distance of the robot cleaner 1, and the moving direction of the robot cleaner.

As a result of the determination in step S230, when the robot cleaner 1 enters the area selected by the user, the control unit 110 compares the preset reference height of the cliff for the selected area with the set height of cliff corresponding to the selected area, and the reference height of cliff is less than the set height of cliff, the reference height of cliff is changed to the set height of cliff (S240).

When the reference height of cliff is greater than or equal to the set height of cliff, the reference height of cliff is not changed.

For example, when the user selects the area No. 1 through the external control device 5 and sets the height of cliff to 15 mm, the reference height of cliff previously set in the area No. 1 is 30 mm, and the robot cleaner 1 enters the area No. 1, the control unit 110 changes the reference height of the cliff in the first area to 15 mm.

Thereafter, when the distance data detected by the lower sensors 123, 124, and 125 is equal to or greater than the reference height of the cliff, the control unit 110 determines that the cliff is detected (S250).

The robot cleaner 1 drives autonomously while performing a cleaning operation, and the lower sensors 123, 124, and 125 continuously detect the relative distance between the lower side of the robot cleaner 1 and the floor surface B as distance data of the space to be cleaned. Then, when the distance data detected by the lower sensors 123, 124, and 125 is equal to or greater than the reference height of cliff, the control unit 110 of the robot cleaner determines that the cliff is detected.

For example, when the robot cleaner 1, which is driving on the mattress, drives to the vicinity of the edge of the mattress and detects distance data of 15 mm or more by the lower sensors 123, 124, and 125, the control unit 110 may determine that the cliff is detected.

When it is determined that the cliff is detected, the control unit 110 controls the first actuator 56 and the second actuator 57 to perform an avoidance operation to avoid the cliff (S260). Of course, while it is not determined that the cliff is detected, the avoidance operation is not performed, the process returns to step S230, and the cleaning operation is continuously performed.

The avoidance operation may be to control the first actuator 56 and the second actuator 57 so that only one of the first rotation plate 10 and the second rotation plate 20 rotates as described above. In this case, the driving direction of the robot cleaner 1 may be changed.

Alternatively, the avoidance operation is to control the first actuator 56 and the second actuator 57 so that the first rotation plate 10 and the second rotation plate 20 rotate in an opposite direction to the rotation direction up to that time. In this case, the moving direction of the robot cleaner 1 is changed to the opposite direction to the direction in which the robot cleaner 1 is driving, so that the robot cleaner 1 may move backward.

Alternatively, the avoidance operation may be to control the first actuator 56 and the second actuator 57 so that the first rotation plate 10 and the second rotation plate 20 stop rotating.

In this case, the robot cleaner 1 stops driving so as not to fall to the cliff.

For example, when a cliff is detected at the edge of the mattress, the control unit 110 controls the first actuator 56 and the second actuator 57 to make the robot cleaner 1 move backward or change the direction to the left or right or stop driving.

The above-described process ends when the cleaning operation is completed, and when the cleaning operation continues, the process returns to step S230 and repeats (S270).

In this way, the user can select one or more areas among a plurality of divided areas of the space to be cleaned to set different height of cliffs, and since the robot cleaner 1 can be controlled accordingly, it is possible to more precisely control the operation of the robot cleaner 1 even in the same space to be cleaned, according to the arrangement of furniture, the structure of the space, and the like.

On the other hand, as a result of the determination in step S230, if the robot cleaner 1 does not enter the selected area, the control unit 100 compares the reference height of cliff and the distance data detected by the lower sensor and determines whether a cliff is detected while controlling the driving of the robot cleaner 1 according to step S250.

FIG. 9 is a conceptual diagram of a robot cleaning system according to another embodiment of the present invention, and FIG. 10 is a method of performing a cooperative cleaning operation in conjunction with another cleaner in a control method of a robot cleaning system according to another embodiment of the present invention, FIGS. 11*a* and 11*b* are views illustrating a control screen of an external control device for setting the cooperative cleaning operation in a robot cleaning system according to another embodiment of the present invention.

The robot cleaning system 1000*b* according to another embodiment of the present invention may include a robot cleaner 1*a*, other cleaner 2 to perform a cleaning operation in cooperation with the robot cleaner, and an external control device 5.

The robot cleaner 1*a* may have the same configuration as the robot cleaner 1 of the robot cleaning system 1000*a* according to an embodiment of the present invention. The other cleaner 2 may be a cleaner that performs a cleaning operation by sucking dust, a robot cleaner that drives autonomously, or a wired/wireless type stick cleaner operated by a user directly. The external control device 5 may have the same configuration as the external control device 5 of the robot cleaning system 1000*a* according to an embodiment of the present invention.

Referring to FIG. 10, first, the external control device 5 receives a user input selecting other robot cleaner 2 on the control screen (S5100).

Referring to FIG. 11*a*, an interlocking operation item C40 for cooperatively performing a cleaning operation by interlinking a plurality of cleaning periods may be displayed on the control screen of the external control device 5. When the external control device 5 receives a user input selecting the interlocking operation item C40, a screen for selecting an interlocking product may be displayed on the external control device 5.

Referring to FIG. 11*b*, a user may select a cleaner to be interlocked with the robot cleaner 1*a* among a plurality of registered cleaners C42*a*, C42*b*, and C42*c* displayed on the screen for selecting a product to be interlocked. For example, the user may select a stick cleaner 1 (C42*b*).

The control unit 580 of the external control device 5 receives the user input selecting the other cleaner 2 and generates the control signal for interlocking a plurality of cleaning periods, and transmits it to the robot cleaner 1*a* and the selected other cleaner 2 (S5200).

In a state in which the control signal for interlocking the plurality of cleaning periods is transmitted to each of the cleaners 1*a* and 2, the other cleaner 2 interlocked with the robot cleaner 1*a* starts the cleaning operation (S5400) and completes the cleaning operation (S5500), and then the other cleaner 2 generates a completion signal of the cleaning operation and transmits it to the robot cleaner 1*a* (S5600).

When the robot cleaner 1*a* receives the completion signal of the cleaning operation transmitted by the other cleaner 2 through the communication unit 160 (S5700), the control unit 110 of the robot cleaner 1*a* controls the robot cleaner 1*a* to start the cleaning operation (S5800).

In this way, since the robot cleaner 1*a* can immediately perform the wet mop cleaning in conjunction with a plurality of cleaning periods after the cleaning operation for sucking dust is completed, the wet mop cleaning can be started without the user's separate control, so user convenience can be further increased.

Although the above-described embodiment has been described by taking the height of cliff as the reference distance as an example, the above-described embodiment may be equally applied even when a wall distance is set as the reference distance.

As described above, the robot cleaner according to an embodiment of the present invention can control the robot cleaner not to fall into inability to drive according to the cleaning environment by controlling the actuator of the robot cleaner based on the reference distance set by the user.

In addition, the robot cleaning system according to the present invention includes an external control device that receives a user input and displays a control screen capable of setting a reference distance on the robot cleaner, so that the user can remotely and conveniently set the driving control of the robot cleaner.

Meanwhile, the block diagrams disclosed in the present disclosure may be interpreted by those of ordinary skill in the art as a form conceptually expressing a circuit for implementing the principles of the present disclosure. Similarly, it will be appreciated by those of ordinary skill in the art that any flow charts, flow diagrams, state transition diagrams, pseudocode, etc. may be represented substantially on a computer-readable medium, and represent a variety of processes that may be executed by such a computer or processor, whether or not explicitly shown.

Accordingly, the above-described embodiments of the present disclosure can be written in a program that can be executed on a computer, and can be implemented in a general-purpose digital computer operating the program using a computer-readable recording medium. The computer-readable recording medium may include a storage medium such as a magnetic storage medium (for example, a ROM, a floppy disk, a hard disk, etc.), an optically readable medium (for example, a CD-ROM, a DVD, etc.), and the like.

The functions of the various elements shown in the drawings may be provided through the use of dedicated hardware as well as hardware capable of executing software in association with appropriate software. When provided by a processor, such function may be provided by a single dedicated processor, a single shared processor, or a plurality of separate processors, some of which may be shared.

In addition, the explicit use of the terms "processor" or "control unit" should not be construed as referring exclusively to hardware capable of executing software, and without limitation, digital signal processor (DSP) hardware, read only memory (ROM) for storing software, random access memory (RAM), and non-volatile storage may be implicitly included.

In the foregoing, a specific embodiment of the present invention has been described and illustrated, but the present invention is not limited to the described embodiment, and it will be understood by those skilled in the art that various modifications and variations can be made in other specific embodiments without departing from the spirit and scope of the present invention. Accordingly, the scope of the present invention should not be determined by the described embodiment, but should be determined by the technical idea described in the claims.

DESCRIPTION OF REFERENCE NUMERALS

1000*a*, 1000*b*: robot cleaning system
1: robot cleaner
2: other cleaner
5: external control device
10: first rotation plate
20: second rotation plate
30: first mop
40: second mop
50: body
56: first actuator
57: second actuator
110: control unit
120: sensor unit
122: distance sensor
123: first lower sensor
124: second lower sensor
125: third lower sensor

The invention claimed is:

1. A robot cleaner which cleans a cleaning surface while automatically driving, the robot cleaner comprising:

a body;

a first rotation plate that is coupled to the body to rotate and to whose lower side a first mop facing the cleaning surface is coupled;

a second rotation plate that is coupled to the body to rotate and to whose lower side a second mop facing the cleaning surface is coupled;

a sensor unit that is coupled to the body and detects a height from the cleaning surface to a lower side of the body as distance data;

a first actuator that is coupled to the body to provide power to rotate the first rotation plate; and a second actuator that is coupled to the body to provide power to rotate the second rotation plate;

wherein the first actuator and the second actuator are controlled based on a height of a cliff set by a user input through an external control device and the distance data detected by the sensor unit.

2. The robot cleaner according to claim 1, further comprising a control unit that controls operations of the first actuator and the second actuator by communicating with the external control device, wherein the control unit receives the user input setting the height of the cliff through the external control device, the control unit changes a reference height of the cliff that is preset in the robot to the set height of the cliff if the reference height of the cliff that is preset in the robot cleaner is less than the height of the cliff set by the user input, the control unit determines that the cliff is detected if the distance data detected by the sensor unit is greater than the reference height of the cliff, and the control unit controls the first actuator and the second actuator to perform an avoidance operation to avoid the cliff.

3. The robot cleaner according to claim 1, further comprising a control unit that controls operations of the first actuator and the second actuator by communicating with the external control device, wherein the control unit receives a user input selecting one or more areas among a plurality of divided areas of the cleaning surface, and a user input setting a height of the cliff corresponding to each of the one or more areas selected by the user input through the external control device, when the robot cleaner enters one of the selected one or more areas, the control unit compares a preset reference height of the cliff for the selected area with the height of the cliff set by the user input corresponding to the selected area, and changes the reference height of the cliff to the set height of the cliff if the reference height of the cliff is less than the set height of the cliff, the control unit determines that the cliff is detected if the distance data detected by the sensor unit is greater than the reference height of the cliff, and the control unit controls the first actuator and the second actuator to perform an avoidance operation to avoid the cliff.

4. The robot cleaner according to claim 2, wherein the control unit controls the first actuator and the second actuator so that only one of the first rotation plate and the second rotation plate rotates.

5. The robot cleaner according to claim 2, wherein the control unit controls the first actuator and the second actuator so that the first rotation plate and the second rotation plate respectively rotate in opposite directions.

6. A robot cleaning system comprising:

a robot cleaner that cleans a cleaning surface while autonomously driving;

an external control device that displays a control screen for controlling the robot cleaner and receives a reference distance for detecting a surrounding environment of the cleaning surface, the reference distance being set by a user input through the control screen; and a sensor unit that detects a height from the cleaning surface to a lower side of the robot cleaner as distance data, wherein the robot cleaner is controlled based on the reference distance set by the user input through the external control device and the distance data detected the sensor unit.

7. The robot cleaning system according to claim 6, wherein the sensor unit comprises a lower sensor provided on the robot cleaner and that detects the height from the cleaning surface to the lower side of the robot cleaner, the reference distance set by the user input is a height of a cliff, and the external control device displays a plurality of items capable of being selected by the user input on the control screen.

8. The robot cleaning system according to claim 7, wherein when the user selects one item among the plurality of items, the external control device transmits information about the height of the cliff corresponding to the selected item to the robot cleaner.

9. The robot cleaning system according to claim 6, further comprising another cleaner to perform a cleaning operation in cooperation with the robot cleaner, wherein when the external control device receives a user input selecting the other cleaner on the control screen, the robot cleaner starts a cleaning operation based on receiving a cleaning completion signal transmitted after the other cleaner completes cleaning.

* * * * *